US008353434B2

(12) United States Patent
Clayton, III et al.

(10) Patent No.: US 8,353,434 B2
(45) Date of Patent: Jan. 15, 2013

(54) SYSTEM FOR CARRYING ARTICLES AT THE FRONT TORSO OF A HUMAN BEING

(75) Inventors: Frank Brittin Clayton, III, Boulder, CO (US); Wilson S. Clayton, Evergreen, CO (US); Karen B. Clayton, Evergreen, CO (US)

(73) Assignee: Cedar Mesa Design Company LLC, Boulder, CO (US)

( * ) Notice: Subject to any disclaimer, the term of this patent is extended or adjusted under 35 U.S.C. 154(b) by 1269 days.

(21) Appl. No.: 11/582,605

(22) Filed: Oct. 17, 2006

(65) Prior Publication Data

US 2007/0090143 A1 Apr. 26, 2007

Related U.S. Application Data

(60) Provisional application No. 60/728,937, filed on Oct. 22, 2005, provisional application No. 60/743,332, filed on Feb. 21, 2006.

(51) Int. Cl.
*A45F 3/10* (2006.01)

(52) U.S. Cl. ..... 224/634; 224/623; 224/637; 224/638; 224/647; 224/272

(58) Field of Classification Search ..... 224/623, 224/628, 631, 634, 637, 638, 646, 647, 611, 224/261–263, 265, 910
See application file for complete search history.

(56) References Cited

U.S. PATENT DOCUMENTS

| | | | | |
|---|---|---|---|---|
| 921,900 | A | 5/1909 | Shuster | |
| 1,275,514 | A * | 8/1918 | Wolak | 224/161 |
| 2,886,031 | A * | 5/1959 | Robbins | 602/19 |
| 3,355,075 | A * | 11/1967 | Dean | 224/262 |
| 4,037,763 | A | 7/1977 | Turchen | |
| 4,083,480 | A * | 4/1978 | Lee et al. | 224/185 |
| 4,114,788 | A | 9/1978 | Zufich | |
| 4,133,464 | A * | 1/1979 | Kelty | 224/262 |
| 4,214,685 | A | 7/1980 | Pletz | |
| 4,480,775 | A | 11/1984 | Stanford | |
| 4,504,002 | A * | 3/1985 | Hall | 224/641 |
| 4,892,240 | A | 1/1990 | Bell | |

(Continued)

FOREIGN PATENT DOCUMENTS

JP 3128449 U 12/1991

(Continued)

OTHER PUBLICATIONS

Supplementary European Search Report for European Patent Application No. EP 06826344, dated Mar. 16, 2009.

(Continued)

*Primary Examiner* — Nathan J Newhouse
*Assistant Examiner* — John Cogill
(74) *Attorney, Agent, or Firm* — Faegre Baker Daniels LLP

(57) ABSTRACT

A system for carrying articles at the front torso of a human being is disclosed. A substantially rigid article-carrying frame is connected to the front of a harness or backpack worn by the user. The frame transmits the weight of the front-carried articles to the front of the user's hips. The system accommodates bending movements of the user's torso by providing, for example, a variable-length mechanism, or a bending mechanism, or a folding mechanism, or a sliding connector mechanism, or any other equivalent accommodation mechanism that will allow the system to accommodate bending movements of the torso of the user.

53 Claims, 18 Drawing Sheets

U.S. PATENT DOCUMENTS

| | | | | | |
|---|---|---|---|---|---|
| 4,911,346 | A | | 3/1990 | Shallman | |
| 5,400,683 | A | * | 3/1995 | LaFlame | 84/421 |
| 5,462,518 | A | * | 10/1995 | Hatley et al. | 602/36 |
| 5,497,922 | A | | 3/1996 | Tate | |
| 5,503,314 | A | | 4/1996 | Fiscus | |
| 5,586,703 | A | | 12/1996 | Radar et al. | |
| 5,634,576 | A | | 6/1997 | Arbel | |
| 5,676,294 | A | * | 10/1997 | Eklund et al. | 224/625 |
| 5,890,640 | A | * | 4/1999 | Thompson | 224/630 |
| 5,954,250 | A | * | 9/1999 | Hall et al. | 224/262 |
| 5,975,389 | A | | 11/1999 | Braun et al. | |
| 6,280,405 | B1 | * | 8/2001 | Broselid | 602/36 |
| 6,336,576 | B1 | | 1/2002 | Easter | |
| 6,397,392 | B1 | | 6/2002 | Wooley et al. | |
| 6,402,003 | B1 | | 6/2002 | Jackson | |
| 6,619,523 | B1 | * | 9/2003 | Duckworth | 224/634 |
| 6,790,201 | B2 | * | 9/2004 | Meyer | 604/345 |
| 7,097,368 | B2 | * | 8/2006 | Gonzales | 396/420 |
| 7,166,790 | B2 | * | 1/2007 | May | 84/421 |
| 7,219,867 | B2 | * | 5/2007 | Kalis et al. | 248/288.31 |
| 7,673,776 | B2 | * | 3/2010 | May | 224/266 |
| 7,784,953 | B2 | * | 8/2010 | Rumsey et al. | 359/880 |

FOREIGN PATENT DOCUMENTS

| | | | |
|---|---|---|---|
| WO | WO2004082426 | A2 | 9/2004 |

OTHER PUBLICATIONS

Supplementary European Search Report dated Mar. 16, 2009, for Application No. EP 06826344.1.

International Search Report and Written Opinion for PCT/US06/41019, mailed Apr. 14, 2007.

Office Action issued in JP Application No. 2008-536822, mailed May 2, 2012, with English translation, 14 pages.

* cited by examiner

SYSTEM FOR CARRYING ARTICLES AT THE FRONT TORSO OF A HUMAN BEING

RELATED APPLICATIONS

This application claims the benefit of U.S. Provisional Patent Application Ser. No. 60/728,937, filed Oct. 22, 2005, and claims the benefit of U.S. Provisional Patent Application Ser. No. 60/743,332, filed Feb. 21, 2006, which are incorporated herein by reference.

BACKGROUND

1. Field

The system lies in the field of package and article carriers, and more specifically, devices or systems for carrying articles by an animate bearer, and systems for carrying articles at the front torso of a human being.

2. Discussion of the Background

Since time immemorial, human beings have used systems to assist them in carrying articles. People have used, for example, garment pockets, hand-carried containers, shoulder slings, backpacks, and frontpacks.

For anatomical reasons it is usually more efficient to carry an extremely heavy load on the back of the torso, for example, using a backpack. However, a frontpack—i.e., a system for carrying articles at the front of the torso—offers at least two load-carrying advantages.

First, a frontpack enables the user to conveniently see and reach the carried articles without removing the carrier system from the body. This is especially practical for retrieving and replacing frequently used articles such as cameras, binoculars, water bottles, hats, gloves, and the like.

Second; when used in conjunction with a backpack, a frontpack counterbalances certain masses and forces of the backpack upon the user's body, making the total load feel lighter and more comfortable to carry. Redistributing a portion of the total weight of the carried articles from the back of the body to the front of the body shifts the center of gravity of the total load forward, toward the natural center of gravity of the user's body, allowing the user to stand and move in a more natural upright position. If the frontpack has a load-bearing frame that transmits the weight of the front-carried load to the frontal area of the user's hips, the downward force on the front of the pelvic bones will counterbalance the downward force of the backpack on the back of the pelvic bones, bringing the pelvis into a more natural alignment with less strain on low back muscles. A well-designed frontpack frame will also generate forward horizontal forces upon the upper shoulder straps of the backpack to which the frontpack is attached, which will counteract the rearward horizontal forces upon the upper shoulder straps generated by the backpack and its contents. These biomechanical advantages of a frontpack combine to give the user improved comfort, balance, and physical capability while carrying a heavy load.

During the past several decades, the art of backpack design has advanced considerably. Early backpacks consisted of little more than flaccid bags suspended from the user's shoulders by simple straps. Today, state-of-the-art backpacks utilize rigid frames to transfer the weight of the load to the user's hips, which is the optimal anatomical location for a person to bear a heavy load. Modern suspension systems are adjustable and utilize padded and anatomically shaped shoulder straps and hip belts for improved fit, comfort, freedom of movement, and load stability. These advancements allow the users of modem backpacks to carry heavier loads and to engage in more physically demanding activities than was possible at any time in the past.

Devices for carrying articles at the front of the human torso have not seen similar advancements in design or performance. In the prior art, no frontpack system is known that has offered satisfactory weight transfer to the hips, adjustability, comfort, freedom of movement, and load stability.

The simplest prior art frontpack designs involve a container suspended from a single strap deployed over the user's neck or a single shoulder. A supplemental strap is sometimes deployed circumferentially around the user's torso to limit the bouncing and swaying of the front-carried load. Frontpacks of this type suffer from a fundamental shortcoming in the relatively limited capacity of the human neck and shoulders to carry a heavy load. Even a comparatively light item such as a camera or pair of binoculars becomes uncomfortable when suspended from the neck or a single shoulder for a sustained period of time.

Another form of unsophisticated frontpack involves the use of pockets sewn into the front of a garment. Examples of this approach are found in a traditional fisherman's vest and, for example, in the combination backpack/vest taught by Wooley, U.S. Pat. No. 6,397,392, in which a vest has front and rear pockets. This approach affords slightly greater frontal load-carrying capacity, because the weight of the load is distributed over both of the user's shoulders, rather than over the neck or only one shoulder. This approach is still quite limiting, however, due to the lack of weight transfer to the user's hips and practical constraints on the size and shape of front-carry garment pockets.

Another form of unsophisticated frontpack entails, in essence, modifying a backpack so that it can be worn on the front of the body. With minor alterations to the straps and pack bag, a simple frameless backpack design can be adapted to front-carry duty. Examples of this approach are found in a variety of prior art soft frontpacks for carrying infants and small pets. These systems are simple, inexpensive, and adequate for casual and lightweight usage, but the lack of weight transfer to the hips and effective load control capabilities render them unsuitable for sustained or demanding front-carry activities.

Yet another frontpack design approach is exemplified by Radar, U.S. Pat. No. 5,586,703, Baclawski, U.S. Pat. No. 5,634,579, and Jackson, U.S. Pat. No. 6,402,003, each of which teaches frontal pockets suspended from the shoulder straps of a backpack. Because these systems cooperate with a modern backpack, they offer improved comfort and load-carrying capacity due to the exploitation of modern backpack shoulder strap design and the ability to achieve improved back-to-front weight distribution. However, none of these systems achieves the transfer of front-carried weight directly to the user's hips, where the load can be carried most comfortably and efficiently; nor do these systems provide adequate load control capabilities.

Several prior art frontpack systems have made advances in transferring the weight of the front-carried load downward to the hips of the user by utilizing a rigid framework to support the front-carried load. One category of such systems utilizes a rigid backpack frame with sections that extend forward from the backpack to the front of the user's body. The weight of articles carried on the forward-extending frame sections is mechanically transferred to the backpack and thus is carried on the back of the user's body. This approach is seen, for example, in Turchen, U.S. Pat. No. 4,037,763, and Zufich, U.S. Pat. No. 4,114,788. These systems achieve some success in mechanically transferring a portion of the weight of the front-carried load to the hips of the user, via the backpack frame. However, because there is no support for the front-carried load at the front of the user's body, these systems lack effective load control capability and do not achieve any balancing of the downward forces at the back and front of the user's pelvic bones.

The foregoing deficiencies and limitations are avoided to some degree in the class of front-carry systems that utilizes a rigid framework to transfer the weight of the front-carried load, or at least a portion of it, directly downward to the frontal area of a hip belt worn by the user. This design approach is exemplified in Stanford, U.S. Pat. No. 4,480,775, Bell, U.S. Pat. No. 4,892,240, Easter, U.S. Pat. No. 6,336,576, and Tate, U.S. Pat. No. 5,497,922. While these systems represent advancements in the state of the art of frontpacks, each system has shortcomings.

Bell, U.S. Pat. No. 4,892,240, teaches an "exoskeletal carriage" that is essentially a rigid garment to which pockets or other carrying mechanisms may be attached. Such a system provides no means of cooperation with a separate backpack. It is incapable of being adjusted to accommodate the different body shapes and sizes of different users. To achieve adequate control of the front-carried load against bouncing and swaying, the Bell "exoskeleton" must be strapped snugly to the torso. Such snug strapping is uncomfortable and inhibits ventilation of perspiration between the "exoskeleton" and the body. In addition, such snug strapping causes a portion of the weight of the load to be carried upon the upper regions of the torso, and it is therefore counterproductive to full weight transfer to the hips. Perhaps most detrimentally, the rigid "exoskeleton" severely restricts the normal movements of the user's torso. As a person moves through a typical range of motion from reaching up high to bending over forward—or bending from side to side—the person's torso bends and the distance between the front of the hips and the front of the shoulders varies by several inches, sometimes more on one side than on the other. Additionally, when a person's upper torso twists or rotates axially toward the left or the right in relation to the lower torso, the distances between the shoulders and the frontal areas of the hips are changed, sometimes more on one side than the other. Strapping a rigid front-carry plate onto the front torso of the user impedes this range of motion.

The frontpack taught by Stanford, U.S. Pat. No. 4,480,775, utilizes a full external frame, reminiscent of a modern external backpack frame. Stanford's frontal frame is secured to the user's torso by a plurality of straps. With the Stanford system, as with an external frame backpack, the rigid frame theoretically allows for the transfer of a significant portion of the weight of the carried load downward to a hip belt encircling the hips of the user. As taught by Stanford, however, bouncing and swaying of the front-carried load can be controlled only by strapping the framework tightly against the user's torso. Such tight strapping is counterproductive to the transfer of weight to the user's hips. In addition, such tight strapping restricts freedom of movement and diminishes the user's comfort and ventilation. Furthermore, the Stanford frame is not adjustable to accommodate users of different sizes and shapes, and the Stanford body harness is cumbersome and provides no mechanism for cooperation with a separate backpack.

The frontpack described in Easter, U.S. Pat. No. 6,336,576, utilizes a pair of external rigid frame sections to transfer the weight of the frontpack and the front-carried load to the front of a prior art backpack hip belt. Although this design in theory allows reasonable freedom of movement and weight transfer to the front of the hips, the Easter system, like those of Stanford and Bell, lacks effective load control capabilities. Bouncing is inadequately controlled due to the lack of a positive connection between the frontpack and the backpack hip belt. Swaying is ineffectively controlled because the upper region of the frontpack is attached to the sternum strap of the backpack, which is not a stable anchor point. Modest load control can be achieved in the Easter system only by excessively tightening the shoulder straps and the sternum strap, which will inescapably decrease freedom of movement, decrease comfort, and decrease weight transfer to the hip belt. Finally, while the Easter system is especially well-suited to carrying equipment used in the pursuit of wildlife, this specialization renders the system ill-adapted to use for other front-carrying activities.

Tate, U.S. Pat. No. 5,497,922, teaches the use of "counter balance pockets" with rigid internal frame sections to transfer a majority of the weight of the pockets and their contents to the frontal area of a backpack hip belt. Tate has commercially produced this frontpack system and a line of cooperating backpacks sold under the trademark "Aarn Bodypacks." Although Tate's frontpack design in theory provides significant weight transfer to the front of the user's hips, bouncing and swaying in the Tate system can be adequately controlled only by tightening various straps embodied within the system, which inescapably decreases freedom of movement, comfort, and weight transfer to the hip belt. The counterbalance pockets in the Tate system are attached to the shoulder straps of a backpack by a common plastic loop encircling a vertical webbing strap on the backpack shoulder strap. This attachment system affords a limited range of motion for the user's upper torso and limits the ability of the Tate system to cooperate with a wide range of backpacks. Finally, the pockets taught by Tate inherently constrain the size and shape of articles that may be carried. For example, Tate's pockets cannot effectively carry a rifle, a pair of skis, a camera tripod, or an infant.

LuxuryLite (luxurylite.com) offers for sale a "front hydration pack" comprising a clear plastic envelope that hangs by straps from top of a backpack frame and tucks into the front of the hip belt of the backpack. According to the manufacturer, three 24-ounce plastic water bottles bought at a grocery store can be carried inside the frontpack to give it rigidity so the weight of the frontpack is transmitted downward to the user's hips. The LuxuryLite system does not have a rigid integral frame; it does not robustly connect to the hip belt of a backpack; it provides no means of connection to the shoulder straps of a backpack; and it provides no rigid structure in the upper region of the frontpack to prevent the upper region from swaying and rocking during real-world activities like hiking over rough terrain.

It can therefore be seen that there is a need for a frontpack system that will:

(a) transfer a substantial portion of the weight of the frontpack and the front-carried load vertically downward to the frontal area of the user's hips;

(b) accommodate the natural range of motion of the user's torso during diverse activities by automatically changing the length or configuration of the frontpack system to meet and match the dynamic changes in the position of the user's torso;

(c) control the frontpack and any front-carried load against up-and-down bouncing, side-to-side swaying, and front-to-back rocking when the user is moving or traveling;

(d) position and maintain the frontpack and any front-carried load at an optimal distance from the front torso of the user to maximize user comfort;

(e) adjust in multiple dimensions to properly fit users of different sizes and shapes;

(f) carry and secure a wide range of sizes, shapes, and weights of articles; and (g) cooperate with a prior art or future backpack, or with a dedicated front-carry harness, or with any other suitable harness worn by the user.

SUMMARY

The system lies in the field of package and article carriers, and more specifically, systems for carrying articles by an animate bearer, and systems for carrying articles at the front torso of a human being. A system for carrying articles at the front torso of a human being is sometimes referred to herein as a "frontpack."

The system comprises a frame having an upper region and a lower region. The lower region has at least one lower connector to connect the lower region to at least one hip belt worn by the user. The lower region has at least one lower section that is sufficiently rigid to support at least one article secured upon the lower region and to transfer the weight of the at least one article downward to at least one hip belt worn by the user. The upper region of the frame has at least one upper connector to connect the upper region to at least one shoulder strap worn by the user. The upper region has at least one upper section that is sufficiently rigid to position and restrict the movement of the upper region in relation to at least one shoulder strap worn by the user.

The system comprises at least one accommodation mechanism to accommodate bending or twisting of the user's torso by automatically changing the length or configuration of the system during use to meet and match the changes in the position of the user's torso. In some embodiments, the accommodation mechanism is a feature of the frame that enables the upper region to move in relation to the lower region so that the distance between the at least one lower connector and the at least one upper connector can change automatically in response to changes in the position of the user's torso during use of the system. In other embodiments, the accommodation mechanism comprises at least one shoulder strap connector having a shaped area that captures the upper region of the frame to position and restrict the horizontal movement of the upper region in relation to the at least one shoulder strap connector, while leaving the upper region substantially free to move in the vertical dimension in relation to the at least one shoulder strap connector, so that the distance between the at least one shoulder strap connector and the at least one lower connector can change automatically in response to changes in the position of the user's torso during use of the system.

The system comprises a frontpack frame that can adjust to fit different users with different sizes and shapes of torsos. These adjustments allow each user to position and maintain the frame and any front-carried articles at an optimal distance away from the front torso of the user—generally speaking, as close to the user's torso as possible without unduly pressing or rubbing upon the torso—in order to maximize user comfort, balance, and visibility over and around the frontpack system and any front-carried articles.

The system comprises a frontpack frame to which a wide variety of shapes, sizes, and weights of articles can be secured.

The system comprises connectors that enable the frame to connect to and cooperate with a backpack, or a dedicated front-carry harness, or any other suitable harness worn by the user. In some embodiments, the frame is not necessarily connected to any backpack or other harness, but the frame has connectors so that it can be so connected. In other embodiments, the frame is releasably connected to a backpack or other harness. In yet other embodiments, the frame is non-releasably connected to a backpack or other harness.

To accomplish this, a novel system is provided for carrying articles at the front of a human torso.

In this specification, the terms, "up," "down," "top," "bottom," "left," "right," "back," "front," "vertical," "horizontal," and similar directional terms are used in relation to a human being who is using the frontpack system in a normal upright posture, such as in standing, walking, or running.

In this specification, the term "torso" means the human body excluding the head, arms, and legs. "Front torso" means the anterior and the lateral areas of the torso, including the tops of the shoulders and including the sides of the hips, but excluding the posterior areas of the torso. "Upper torso" means the areas of the front torso above the bottom of the rib cage; and "lower torso" means the areas of the front torso below the bottom of the rib cage.

In everyday parlance, the term "hip" or "hips" may be used to refer to several different parts of the body. "Hip" can refer to the hip joint formed by the ball-shaped head of the femur and a corresponding socket in the pelvic bone. "Hip" can refer to the "hipbone" or pelvic bone (which is actually comprised of three fused bones: the ilium, the ischium, and the pubis). "Hip" can also refer more generally to the protrusions of soft tissue in the lateral and posterior aspects of the lower torso.

In this specification, the term "hips" refers specifically to the circumferential region of the torso lying on or near the top of the left ilium and the top of the right ilium, including the left iliac crest and the right iliac crest, and including the soft tissues overlying these bones, and including the frontal area of the torso lying in between the left iliac crest and the right iliac crest. Utilizing this definition, most people wear a pants belt at or near the "hips."

In this specification, the term "hip belt" means any flaccid material, rigid structure, garment, appliance, or other device deployed around or upon all or part of the hips of a human user for the purpose of carrying, securing, or fastening any article to or upon the hips of the user. The term "hip belt" includes what may be commonly referred to as a "waist belt" component of a harness or backpack. The term further includes, but is not limited to, the hip belt of a backpack, the hip belt of a harness such as one resembling a climbing harness or parachute harness, the hip belt of a dedicated or custom harness designed for carrying a frontpack system, the hip-covering material of a suit, pants, or other garment, and any other prior art or future-developed carrying, securing, or fastening device deployed around or upon all or part of the hips of a human user, regardless of whether or not such device completely encircles the hips of the user.

In this specification, the term "frontal area of a hip belt" refers to the part or parts of a hip belt located over the anterior or lateral surfaces of the user's hips at any point from the left-most lateral aspect of the left iliac crest to the right-most lateral aspect of the right iliac crest.

In this specification, the term "shoulder strap" means any flaccid material, rigid structure, garment, appliance, or other device deployed over the top of a shoulder of a human user, for the purpose of carrying, securing, or fastening any article to or upon the shoulder area of the human body. The term includes but is not limited to the shoulder strap of a backpack, the shoulder strap of a harness such as one resembling a climbing harness or parachute harness, the shoulder strap of a dedicated or custom harness designed for carrying a frontpack frame, the shoulder-covering material of a vest, jacket, or other garment, and any other prior art or future-developed securing or fastening device deployed over the top of the shoulder of a human user.

In this specification, the term "frontal area of a shoulder strap" refers to the region of a shoulder strap located over the superior or anterior surfaces of the user's body at any point from the top of the trapezius muscle to the bottom of the pectoral muscle.

In this specification, the term "backpack" means any known art or future-developed apparatus for carrying articles on the back of the user's torso, and which includes at least one shoulder strap and at least one hip belt. The term "backpack" can include but is not limited to external frame backpacks, internal frame backpacks, and frameless backpacks.

In this specification, the term "harness" refers to and includes any prior art or future apparatus that is worn or mounted upon the body of a human user and which includes at least one shoulder strap and at least one hip belt to which a frontpack frame may be releasably or non-releasably connected. The shoulder strap and hip belt elements may be connected to one another directly or by intermediate harness elements; or the shoulder strap and hip belt elements may be isolated and unconnected; or they may be connected in part and unconnected in part. "Harness" includes but shall not be limited to:

(a) a harness having at least a left shoulder strap, a right shoulder strap, and a hip belt to which a frontpack frame can be releasably or non-releasably connected;

(b) a prior art or future backpack having at least a left shoulder strap, a right shoulder strap, and a hip belt to which a frontpack frame can be releasably or non-releasably connected; and (c) any other art known equivalent or future equivalent harness with at least one shoulder strap and at least one hip belt that will allow a human user to carry a frontpack frame at the front of the user's torso.

A system is disclosed and claimed for carrying articles at the front torso of a human user who is wearing a harness. The system comprises a frame having an upper region and a lower region. The lower region of the frame has at least one section that is sufficiently rigid to support the front-carried load and mechanically transfers the weight of the load downward toward the bottom end of the frame. The lower region of the frame has at least one connector for connecting the frame to the frontal area of the at least one hip belt worn on or about the user's hips. The weight of the front-carried load is thereby transferred to a hip belt, which in turn transfers the load to the user's hips—the ideal anatomical location to carry a load. The upper region of the frame has at least one connector to connect the frame to at least one shoulder strap worn by the user. The upper region of the frame is designed so that it does not transmit significant downward force upon the shoulders strap(s) worn by the user. Rather, the upper region transmits a forward horizontal force upon the shoulder strap(s), such that when the frontpack frame is used in conjunction with a backpack, the forward force of the frontpack upon the shoulder strap(s) counteracts the rearward horizontal force upon the shoulder straps generated by the backpack and contents thereof.

The frontpack system comprises a mechanism that can accommodate changes in the position of the user's torso during anticipated real-world activities. More precisely, the accommodation mechanism permits automatic and continuous variation in the distances between the point(s) where the frame connects to the at least one hip belt and the point(s) where the frame connects to or is constrained to the at least one shoulder strap, to meet and match the dynamic changes in the position of the user's torso.

In some embodiments, the accommodation mechanism is a feature of the frame that enables the upper region of the frame to move in relation to the lower region of the frame. Such an accommodation mechanism can take many forms. For example, the accommodation mechanism can be an inter-sliding assembly selected from the group consisting of, for example but not limited to, sliding telescopic assemblies and sliding dovetailed assemblies, which allows the upper region of the frame to move in the vertical dimension with respect to the lower region of the frame, without the two regions becoming disengaged or displaced within the horizontal dimension. In other embodiments, the accommodation mechanism comprises a folding assembly selected from the group consisting of, for example but not limited to, hinges and ball joints that allows the frame to fold or unfold within a certain range. In yet other embodiments, the accommodation mechanism comprises at least one frame section made of a flexible material. Such flexible frame sections bend when the torso of the user bends or twists, and such frame sections then resume their original shapes when the user's torso assumes a natural upright position.

In yet other embodiments, accommodation of the movement of the user's torso can be achieved by utilizing at least one shoulder strap connector having a shaped area that captures the upper region of the frame and restricts the upper region against movement in the horizontal dimensions, while leaving the upper region free to move in the vertical dimension in relation to the shoulder strap connector. By way of example but not limitation, a ring-shaped shoulder strap connector can capture a rod-shaped upper frame section and thereby constrain the upper region in the horizontal dimensions so as to maintain the frame at a desired distance position from the user's torso, but the upper region remains free to move up and down to accommodate movements of the user's torso.

Any other known art equivalent or future equivalent accommodation mechanism that will allow a user freedom of movement of the torso while wearing a frontpack frame is considered to be an "accommodation mechanism" within the meaning of this specification.

The frontpack frame of the system controls against up-and-down bouncing, left-to-right swaying, and front-to-back rocking of the frontpack frame and any load that it carries. A substantially rigid lower region of the frame and positive mechanical connections between the lower region and a hip belt worn by the user combine to minimize movement of the frontpack frame and front-carried load in all dimensions in relation to the user's lower torso. A substantially rigid upper region and positive mechanical connections between the upper region and at least one shoulder strap worn by the user combine to control left-to-right swaying and front-to-back rocking of the frame and the front-carried load.

As is detailed below, the system allows adjustments in several dimensions to optimally fit different users with torsos of different sizes and shapes. In some embodiments, the lengths and angular positions of various sections of the frame can be mechanically adjusted to fit different users of different lengths, widths, and curvatures in the area of the torso. In other embodiments, sections of the frame are bendable to fit users of different torso sizes and shapes. These adjustments allow the user to connect the frame to at least one shoulder strap and at least one hip belt at optimal anatomical locations. In addition, these adjustments allow the user to position and maintain the frontpack frame at an optimal distance away from the front torso of the user. Generally speaking, the optimal positioning will place the frame as close to the user's torso as possible without unduly pressing or rubbing upon the torso. This will maximize user comfort, balance, and visibility over and around the frontpack frame and any front-carried articles.

In some embodiments of the system, there is only one section in the upper region of the frame, one section in the lower region of the frame, one accommodation mechanism, one upper connector, and one lower connector, all of which are aligned in an approximately vertical orientation, such that they can be disposed entirely on one side of the user's body—either the left side or the right side—or at approximately the vertical mid-line of the body. Such an embodiment can be advantageous when, for example, the user does not need to carry a heavy load and prefers a very lightweight and unobtrusive frontpack frame.

In other embodiments of the system, at least one section of frame in the upper region, at least one section of frame in the lower region, and at least one accommodation mechanism are disposed at approximately the vertical mid-line of user's body, while there are other frame sections, upper connectors, and lower connectors disposed on both the left side and the right side of the user's body. Such an embodiment can be advantageous when, for example, the user is a female and it is desirable to position an accommodation mechanism and certain frame sections in between the user's breasts for improved fit and comfort, while still taking advantage of at least four points of connection to a backpack or harness for improved load-carrying capacity and stability.

In yet other embodiments of the system, there are upper region frame sections, lower region frame sections, accommodation mechanisms, upper connectors, and lower connectors disposed on both the left and right sides of the user's body. Such an embodiment can be advantageous when, for example, the user desires maximum load-carrying and control capabilities and independent accommodation mechanisms located on both the left and right sides of the body.

It will be readily apparent to one skilled in the art that the several elements of the system can be positioned to the left, to the right, to the left and right, or at the center of the user's body—and in myriad combinations of these positions. All of these arrangements and permutations are intended to be within the scope of this specification and the attached claims.

The system includes connectors to connect the frame to a shoulder strap and a hip belt, as defined above. In some embodiments, the frame is not necessarily connected to a harness, but the frame has connectors so that it can be so connected. In other embodiments, the frame is non-releasably connected to a harness. In yet other embodiments, releasable connector systems are provided in which the frame can be releasably connected to a harness. In all of the embodiments, it is easy for the user to don and doff the frontpack system.

The system also comprises at least one frame section in the lower region to which at least one article can be secured. The frame section can be, for example but not limited to, a vertical frame section, a horizontal frame section, a platform, or a frame section with an opening, or some combination of these. Articles can be secured to the frame by any suitable prior art or future article securing mechanism, selected from the group consisting of, for example but not limited to, straps, buckles, and holders, or some combination of these.

These embodiments of the frontpack frame system will become apparent to those skilled in the art from the following detailed description and accompanying drawings, showing the contemplated novel elements, constructions, and combinations herein described. It must be understood that all equivalents and changes in the precise embodiments of the frame disclosed below are meant to be included as coming within the scope of the disclosure.

BRIEF DESCRIPTION OF THE DRAWINGS

The foregoing and other features will be apparent from the following, more particular description of the embodiments, as illustrated in the accompanying drawings wherein like reference numbers generally indicate identical, functionally similar, and/or structurally similar elements and refer to like elements throughout, and in which.

DETAILED DESCRIPTION

Figure 1:
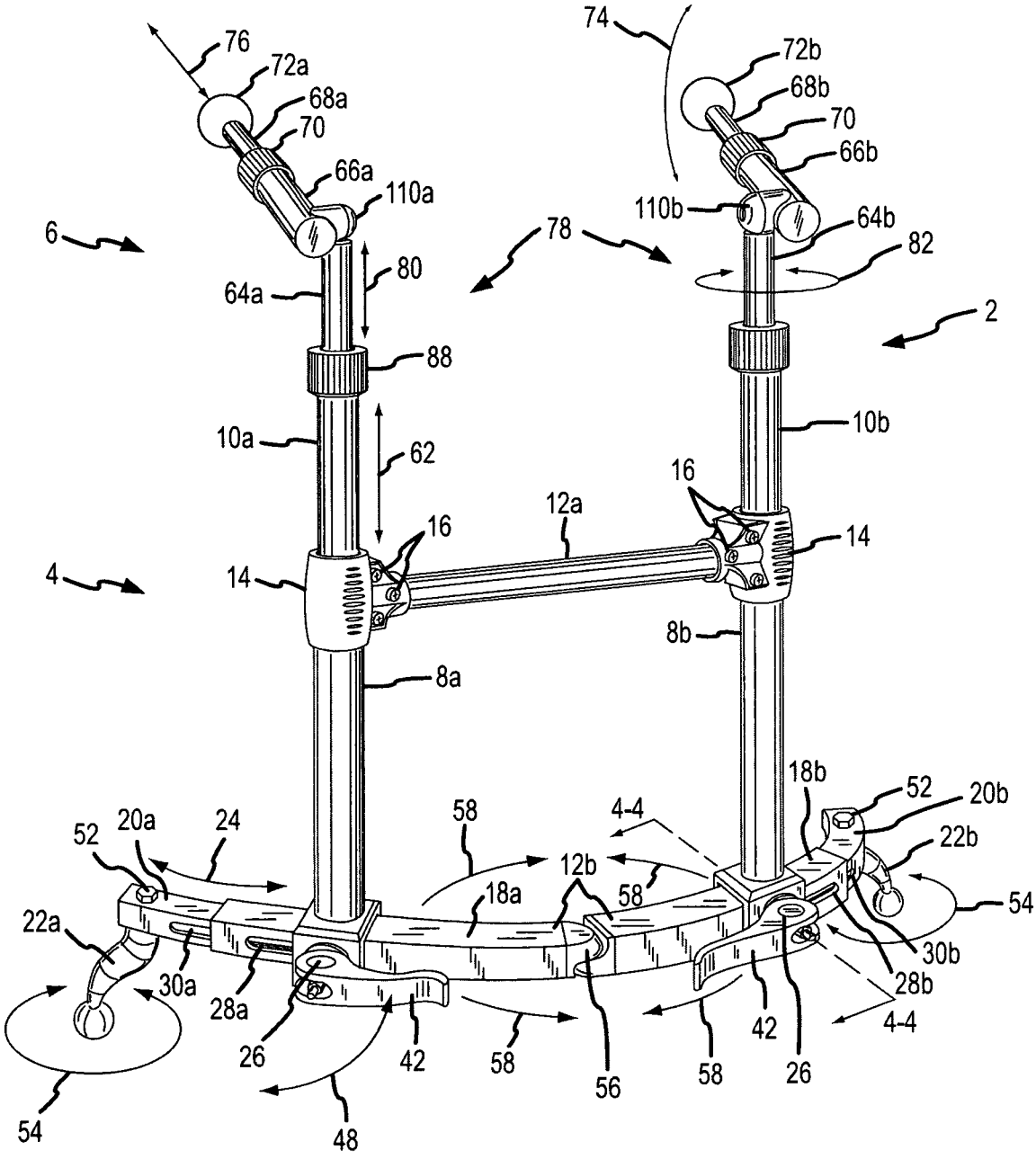
FIG. 1 is a perspective view of an embodiment of a frontpack system comprising a frame with semi-spherical lower connectors and upper connectors that are not connected to a harness, but which are capable of being connected to a harness.

In describing the system illustrated in the figures, specific terminology is employed for the sake of clarity. The system, however, is not intended to be limited to the specific terminology so selected, and it is to be understood that each specific element includes all technical equivalents that operate in a similar manner to accomplish similar functions.

Referring now to the drawings, wherein identical numerals indicate like parts, FIGS. 1-4 illustrate an embodiment of a system for carrying articles at the front torso of a human user. A frame 2 has a lower region 4 and an upper region 6. The lower region 4 comprises at least one lower section 8 that is sufficiently rigid to support the weight of at least one article secured upon the lower region 4 and to transfer the weight of the at least one article downward.

In the embodiment shown in FIG. 1, the at least one lower section 8 comprises a first lower section 8*a* and a second lower section 8*b* spaced apart from and generally parallel to the first lower section 8*a*. A third lower section 10*a* is telescopically inserted into and connected to the upper end of the first lower section 8*a*. A fourth lower section 10*b* is telescopically inserted into and connected to the upper end of the second lower section 8*b*.

In the embodiment shown in FIGS. 1 through 4, the lower region 4 has at least one horizontal section 12 extending between the first lower section 8*a* and the second lower section 8*b*. The at least one horizontal section 12 in this embodiment comprises an upper horizontal section 12*a* and a lower horizontal section 12*b*. The upper horizontal section 12*a* is connected to the first lower section 8*a* and the second lower section 8*b* by use of collars 14 fixed with bolts 16, as can best be seen in FIG. 3. The lower horizontal section 12*b* is connected to the first lower section 8*a* and the second lower section 8*b* by bolts 34 extending from camming assemblies, as discussed in greater detail below and as can best be seen in FIGS. 3 and 4.

In this embodiment, the lower horizontal section 12*b* comprises a first horizontal section 18*a* connected to the first lower section 8*a* and a second horizontal section 18*b* connected to the second lower section 8*b*. A first horizontal adjustment section 20*a* is telescopically inserted into and connected to the first horizontal section 18*a*, the first horizontal adjustment section 20*a* having a lower connector 22*a*. A second horizontal adjustment section 20*b* is telescopically inserted into and connected to the second horizontal section 18*b*, the second horizontal adjustment section 20*b* having a lower connector 22*b*. A slot 28*a* is placed in the side of the horizontal section 18*a*, and a similar but longer slot 30*a* is placed in the side of the horizontal adjustment section 20*a*. Correspondingly, a slot 28*b* is placed in the side of the horizontal section 18*b*, and a similar but longer slot 30*b* is placed in the side of the horizontal adjustment section 20*b*.

In this embodiment the horizontal section 18 and the horizontal adjustment section 20 both have generally square cross-sections. This allows the horizontal section 18 and the horizontal adjustment section 20 to telescopically engage with one another, while making it difficult for the horizontal adjustment section 20 to rotate within the horizontal section 18 during the carrying of a load upon the frame 2. This is not a necessary or limiting factor of this specification or the appended claims, however, as a frontpack frame 2 can be made of sections having any cross-sectional shape(s) and still be within the teaching of this specification and the scope of the appended claims.

Figure 2:
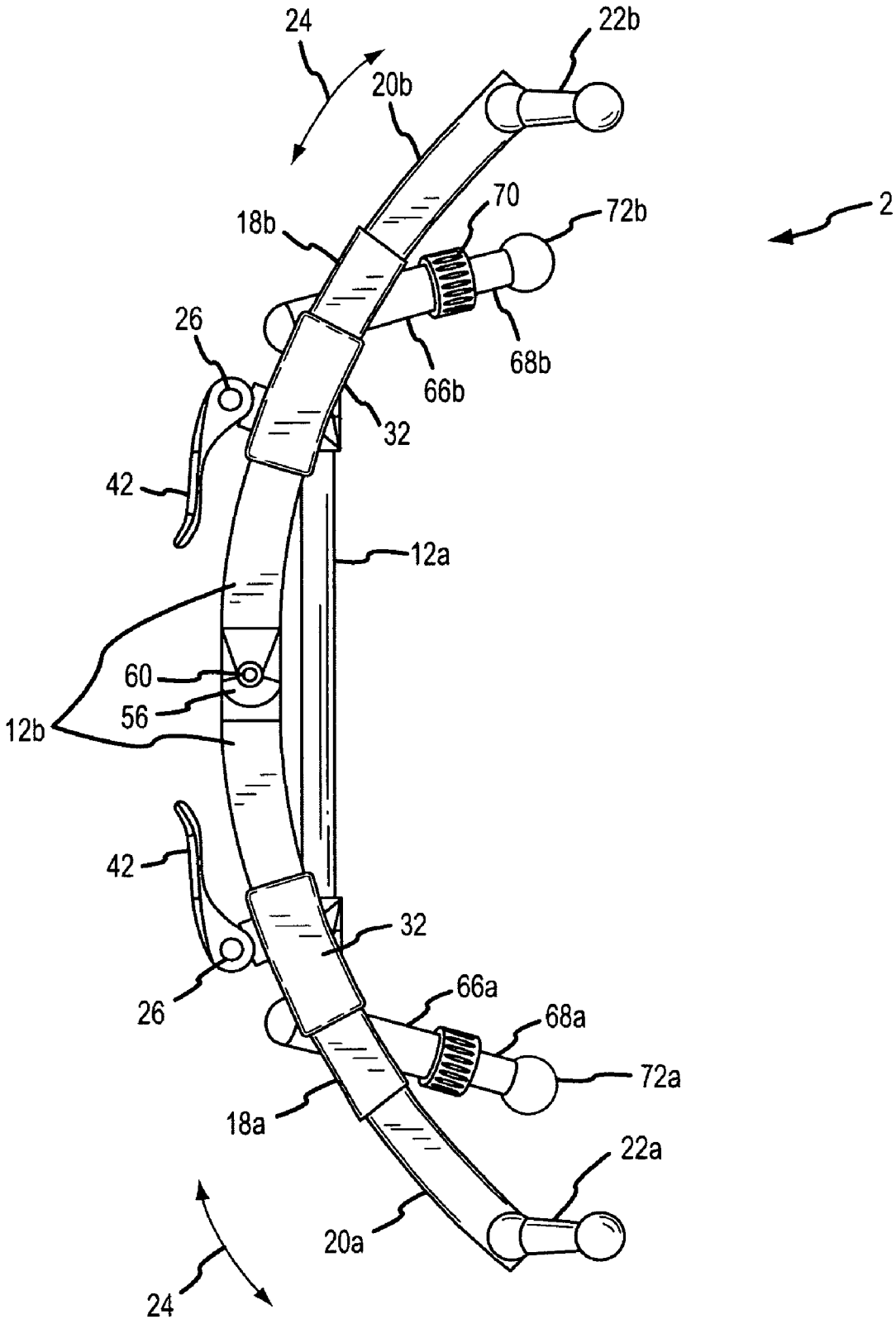
FIG. 2 is a bottom view of the frontpack system of FIG. 1.

As can best be seen in FIG. 2, the first horizontal adjustment section 20*a* slides telescopically within the first horizontal section 18*a*, and the second horizontal adjustment section 20*b* slides telescopically within the second horizontal section 18*b*, as shown by arrows 24. This inter-sliding adjustment mechanism enables the lower region 4 of the frame 2 to be adjusted so that the distance between the first lower connector 22*a* and second lower connector 22*b* can be increased or decreased to fit users of different lower torso widths.

The movement of the horizontal adjustment section 20 is controlled by use of a camming assembly 26. In its open or unlocked position, the camming assembly 26 allows the horizontal section 18 and horizontal adjustment section 20 to slide horizontally in relation to the lower section 8. In its closed or locked position, the camming assembly 26 fixes the horizontal section 18 and horizontal adjustment section 20 in position in relation to the lower section 8. The sliding adjustments of the horizontal section 18 and the horizontal adjustment section 20 aid in adjusting the lower region 4 to fit torsos of different widths and curvatures.

Figure 4:
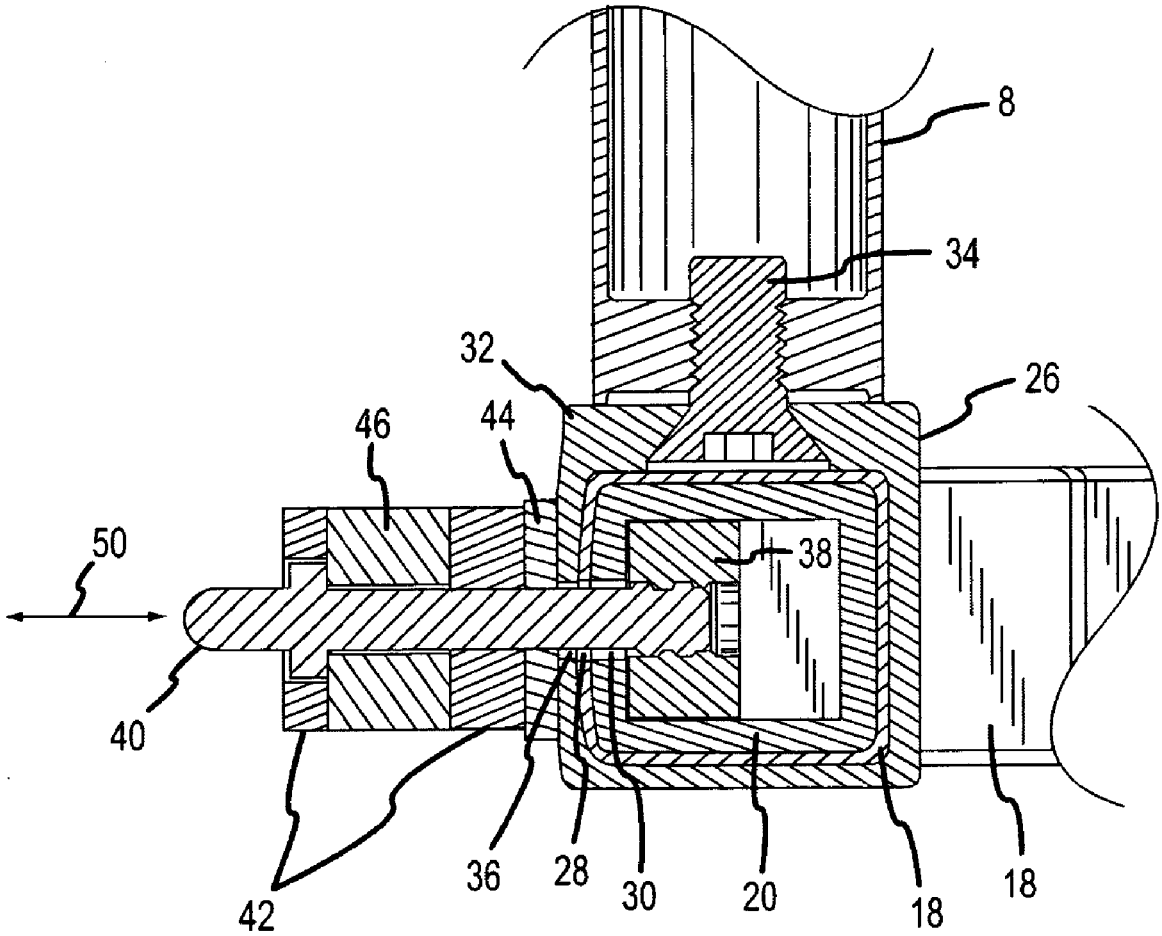
FIG. 4 is a cross-section view along lines 4-4 of FIG. 1 illustrating a quick-release camming lever and bolt assembly.

The function of the camming assembly 26 is best understood by reference to FIG. 4. The camming assembly 26 comprises a box 32 to which the lower section 8 is attached by a countersunken bolt 34. The horizontal section 18 and the horizontal adjustment section 20 are fitted within the box 32 so that their respective slots 28 and 30 align with a hole 36 in the side of the box 32. A threaded dog 38 is inserted inside horizontal adjustment section 20. A rod 40 extends through the hole 36 in the box 32, and through the slots 28 and 30, and is threaded into the threaded dog 38. A camming lever 42 is attached to the other end of the rod 40, which extends outside of the box 32. The camming lever 42 rests against a concave camming nest 44. A cylindrical camming axle 46 lies within a bore (not shown) in the camming lever 42. When the camming lever 42 is moved in the direction of the arrow 48 in FIG. 1 toward the first horizontal section 18, the camming axle 46 pulls the rod 40 toward the outside, as shown by the arrow 50 in FIG. 4, and the rod 40 pulls the threaded dog 38 against the inside of the horizontal adjustment section 20, clamping together the sides of the horizontal adjustment section 20 and the horizontal section 18 against the inside wall of the box 32. When the camming lever 42 is moved away from the horizontal section 18 in the direction shown by arrow 48 in FIG. 1, the camming axle 46 pushes the rod 40 further inside the box 32, thus unclamping the threaded dog 38 from the sides of the horizontal adjustment section 20 and the horizontal section 18. This enables the horizontal adjustment section 20 to be moved in or out of the horizontal section 18 along the directions of arrows 24 to a desired position in relation to the first lower section 8.

The lower region 4 has at least one lower connector 22 to connect the lower region 4 to at least one hip belt. The at least one lower connector 22 is attached to the horizontal section 12 with a bolt 52. In the embodiment illustrated in FIGS. 1-3, the lower connector 22 is pivotally adjustable, enabling a curved range of positioning the semi-spherical end of the lower connector 22, as shown by arrows 54. This curved range of adjustment enables the lower region 4 of the frame 2 to be positioned closer to or farther from the lower torso of the user, and allows for adjustment of the overall horizontal width of the lower region 4 of the frame 2, all as a part of the system of adjustments to fit torsos of different sizes and shapes.

The at least one lower connector 22 is designed to mate with and connect to a prior art or future ball-and-socket type connector system attached to at least one hip belt worn by the user. One example of such a ball-and-socket connector system is the hip belt connector 118 shown in FIG. 8B and discussed below. By virtue of its generally semi-spherical shape, the end of the lower connector 22 can be inserted into a wide variety of ball-and-socket type connector systems, and the end of the lower connector 22 can be inserted into such connector systems at a wide range of angles.

Figure 3:
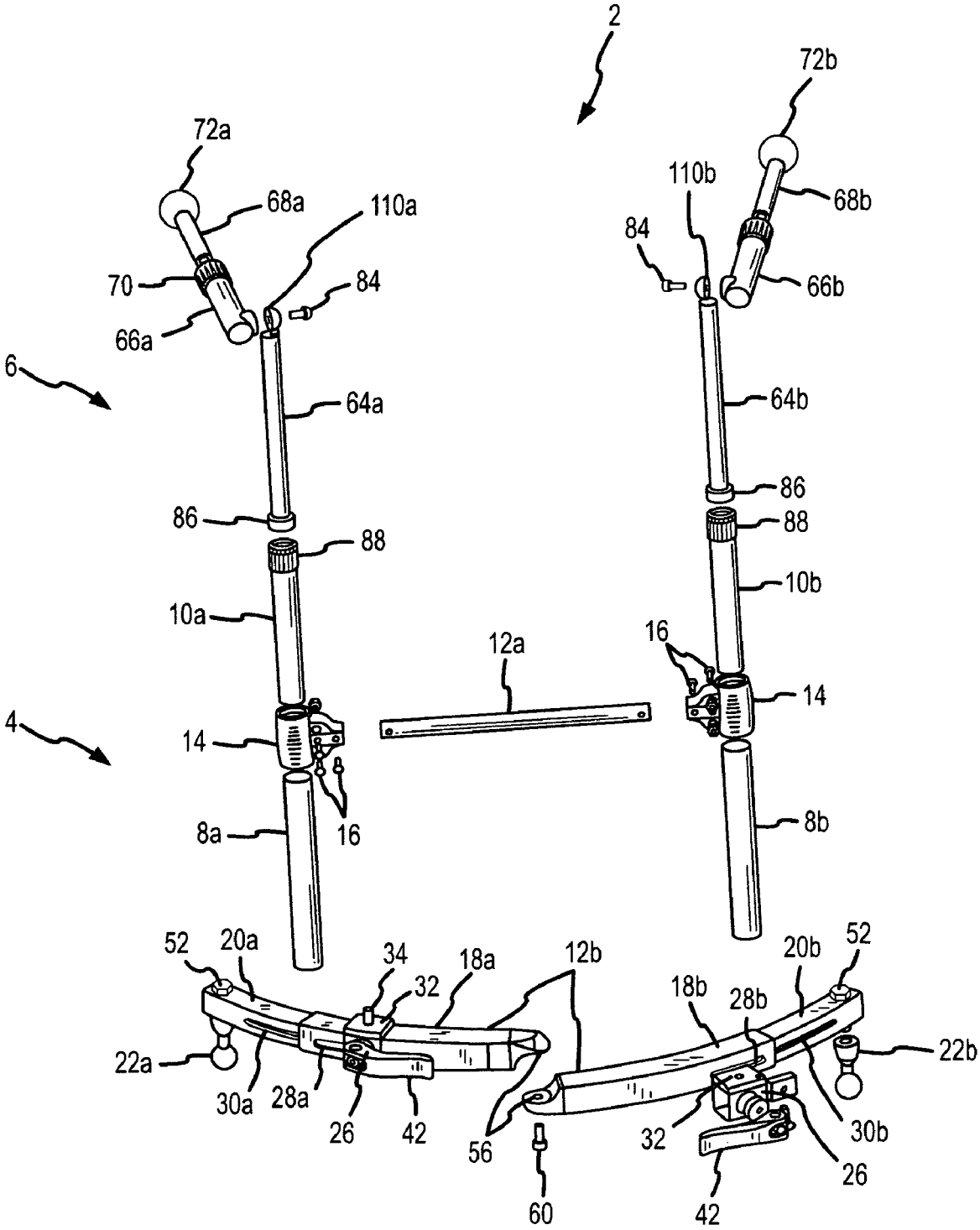
FIG. 3 is an exploded perspective view of the frontpack system of FIG. 1.

As noted above, in the embodiment illustrated in FIGS. 1-4 the lower horizontal section 12*b* comprises first 18*a* and second 18*b* horizontal sections. The first 18*a* and second 18*b* horizontal sections are connected at their proximate ends to form the lower horizontal section 12*b*. In this embodiment the connection is formed by a pivot joint 56 generally located near the center of the lower horizontal section 12*b* of the lower region 4 of the frame 2. The pivot joint 56 enables the first 18*a* and the second 18*b* horizontal sections to be pivoted as shown by arrows 58 to form different angles so as to better match different torso shapes. For example, a user with a relatively flat lower torso can adjust the pivot joint 56 such that the lower horizontal section 12*b* is relatively straight. A user with a rounded lower torso can adjust the pivot joint 56 to a more roomy "V" shape. Once the first horizontal section 18*a* and the second horizontal section 18*b* of the lower horizontal section 12*b* have been adjusted to the desired angular position, the pivot joint 56 is secured in position by use of a bolt 60 or other connector, as illustrated in FIG. 3.

In this embodiment, the lower horizontal section 12*b* has a generally curved shape, as can be seen in FIG. 2. This curved shape corresponds to a typical human curvature in the area of the lower torso and enables the lower region 4 of the frame 2 to be positioned at an optimal distance from the lower torso of a typical user along the entire width of the lower horizontal section 12*b*. This curvature, while advantageous for many users, is not a necessary or limiting factor of this specification or the appended claims. A frontpack system could be constructed with no curved sections (see, for example, FIG. 17 below) and still be within the teaching of this specification and the scope of the appended claims.

As mentioned above, a third lower section 10*a* is telescopically inserted into and connected to the first lower section 8*a*; in like fashion, a fourth lower section 10*b* is telescopically inserted into and connected to the second lower section 8*b*. The third 10*a* and fourth 10*b* lower sections are telescopically movable, as shown by arrows 62, to increase or decrease the vertical height of the lower region 4 of frame 2 to fit various torso lengths. When the third 10*a* and fourth 10*b* sections have been moved to a desired position, the collars 14 are tightened by the plurality of bolts 16 to secure the third 10*a* and fourth 10*b* sections in the desired position.

In this embodiment, the first lower section 8*a*, the second lower section 8*b*, the third lower section 10*a*, the fourth lower section 10*b*, and the at least one horizontal section 12*a,b* are all substantially rigid. When the bolts 16 and camming assemblies 26 in the lower region 4 are properly tightened, the lower region 4 is sufficiently rigid to support at least one article secured upon the lower region 4 and to transfer the weight of the article downward to the first 22*a* and second 22*b* lower connectors, and ultimately to the hips of the user. The rigidity of the lower region 4 also assists in controlling the movement of the lower region 4 and any articles secured upon the lower region 4 against unwanted up-and-down bouncing, front-to-back rocking, and side-to-side swaying during real-world activities by the user.

In the embodiment shown in FIG. 1, the upper region 6 of the frame 2 has at least one upper section 64, comprising a first upper section 64*a* and a second upper section 64*b* spaced apart from and generally parallel to the first upper section 64*a*. A first upper adjustment section 66*a* is connected to the first upper section 64*a*; similarly, a second upper adjustment section 66*b* is connected to the second upper section 64*b*. A third upper adjustment section 68*a* is telescopically inserted into the first upper adjustment section 66*a* and secured by a locking ring 70; similarly, a fourth upper adjustment section 68*b* is telescopically inserted into the second upper adjustment section 66*b* and secured by a locking ring 70.

The third upper adjustment section 68*a* has attached to its distal end at least one upper connector 72*a* to connect the upper region 6 to at least one shoulder strap worn by the user. Similarly, the fourth upper adjustment section 68*b* has attached to its distal end at least one upper connector 72*b* to connect the upper region 6 to at least one shoulder strap worn by the user.

The first 66*a* and second 66*b* upper adjustment sections extend relatively horizontally towards the shoulders of the user. The first 66*a* and second 66*b* upper adjustment sections are pivotally connected to the first 64*a* and second 64*b* upper sections by a first upper pivot 110*a* and a second upper pivot 110*b*, respectively, such that the first 66*a* and second 66*b* upper adjustment sections can pivot up and down with respect to the torso, as shown by arrows 74 in FIG. 1. The first 110*a* and second 110*b* upper pivots are secured in the desired positions by pivot bolts 84 as shown in FIG. 3. The third upper adjustment section 68*a* slides telescopically within the first upper adjustment section 66*a*, and the fourth upper adjustment section 68*b* slides telescopically within the second upper adjustment section 66*b*. This enables the upper region 6 of the frame 2 to be adjusted in horizontal reach as illustrated by arrows 76 in FIG. 1. Conventional locking ring assemblies 70 secure the third 68*a* and fourth 68*b* upper adjustment sections in the desired positions. These adjustment mechanisms allow the user to optimally fit and position the upper region 6 of the frame 2 in relation to the shape and size of the user's upper torso.

As noted, the several adjustment mechanisms in the lower region 4 and the upper region 6 of the frame 2 shown in FIGS. 1-4 can be useful in adjusting the frame 2 to fit users with torsos of different sizes and shapes. These adjustment mechanisms are not, however, a necessary or limiting factor of this specification or the appended claims. A frontpack system could be constructed with less than all of these adjustment mechanisms, or with completely non-adjustable lower region 4 and upper region 6, and still be within the teaching of this specification and within the scope of the appended claims.

In this embodiment, the first 64*a* and second 64*b* upper sections, the first 66*a* and second 66*b* upper adjustment sections, and the third 68*a* and fourth 68*b* upper adjustment sections are all substantially rigid. When the pivot bolts 84 and the locking ring assemblies 70 in the upper region 6 are properly tightened, the upper region 6 is sufficiently rigid to position and restrict the movement of the upper region 6 in relation to the at least one shoulder strap 92 worn by the user. This aids in maintaining the frame 2 at a desired distance from the torso of the user and aids in controlling the frame 2 and any front-carried articles against excessive side-to-side swaying and front-to-back rocking during real world activities.

The first 64*a* and second 64*b* upper sections each has connected to its lower end a flanged bushing 86, as shown in FIG. 3. Each bushing 86 has an outside diameter that is small enough to allow it to slide freely inside of the third 10*a* or fourth 10*b* lower section, respectively. However, the outside diameter of each bushing 86 is too large to allow it to escape through the retaining rings 88 attached to the top of the third 10*a* and fourth 10*b* lower sections. The bushings 86 and retaining rings 88 thus prevent the first 64*a* and second 64*b* upper sections from escaping from the third 10*a* and fourth 10*b* lower sections, respectively.

The at least one upper connector 72 is substantially spherical and is designed to mate with and connect to a prior art or future ball-and-socket type connector system mounted upon a shoulder strap worn by the user. One example of such a ball-and-socket connector system is the shoulder strap connector 116 shown in FIG. 8A and discussed below. Here, as with the at least one lower connector 22, the generally spherical upper connector 72 can be inserted into a wide variety of ball-and-socket type connector systems, and the spherical end can be inserted into such systems at a wide range of angles. The use of a semi-spherical upper connector 72 in the upper region 6 can be advantageous because ball-and-socket joints pivot smoothly and freely within a certain range, enhancing the function of the accommodation mechanism 78 discussed immediately below.

In the embodiment of FIGS. 1-3, the frame 2 has at least one accommodation mechanism 78 that enables the upper region 6 to move in relation to the lower region 4. In this embodiment, the at least one accommodation mechanism 78 comprises at least one inter-sliding assembly, here the inter-sliding telescopic assembly of the first upper section 64*a* inserted into third lower section 10*a*, and the inter-sliding telescopic assembly of the second upper section 64*b* inserted into the fourth lower section 10*b*. The use of round, freely inter-sliding telescopic assemblies allows the first 64*a* and second 64*b* upper sections to move freely up and down vertically within the third 10*a* and fourth 10*b* lower sections, respectively, in the directions shown by arrows 80. In addition, the first 64*a* and second 64*b* upper sections are free to rotate within third 10*a* and fourth 10*b* lower sections, respectively, in the directions shown by arrows 82. These freedoms of movement allow the frame 2 to dynamically change in shape such that the distance between the at least one lower connector 22 and the at least one upper connector 72 can change automatically in response to changes in the position of the user's torso during use of the system. The use of two independent accommodation mechanisms 78—one on the left side and one of the right side of the user—allows for greater freedom of movement for the user over a wider range of real-world activities.

The embodiment of FIGS. 1-4 has an accommodation mechanism 78 comprising a certain type of inter-sliding assembly, namely, a telescopic assembly, but this is not a necessary or limiting factor of this specification or the appended claims. Any type of inter-sliding assembly or non-sliding mechanism that enables the distance between the at least one lower connector 22 and the at least one upper connector 72 to change automatically in response to changes in the position of the user's torso during use of the system is intended to be within the teaching of this specification and the scope of the appended claims.

The frontpack system of FIGS. 1-4 can be releasably connected to any harness having attached to it prior art or future ball-and-socket type shoulder strap connectors and hip belt connectors, such as, for example but not limited to, the shoulder strap connector 116 and hip belt connector 118 shown in FIGS. 8A and 8B, respectively, discussed below. This releasable connectivity can be useful because it allows the frontpack system to be connected to or disconnected from any one of a plurality of different harnesses. For example, a single user might have multiple backpacks, each of which is equipped with ball-and-socket type shoulder strap connectors and hip belt connectors. A single frontpack system of the embodiment of FIGS. 1-4 can easily connect to and disconnect from each of the user's backpacks, thereby providing maximum flexibility to use the frontpack system with different backpacks, and to use each backpack with or without a frontpack.

In the embodiment of FIGS. 1-4, releasable connectivity to a harness is achieved through the use of semi-spherical lower 22 and upper 72 connectors that are compatible with the socket portion of a prior art or future ball-and-socket type of releasable connector system. However, the use of a ball-and-socket type of releasable connector system is not a necessary or limiting factor of this specification or the appended claims. The use of any type of prior art or future releasable connector system to releasably connect the frontpack frame 2 to a harness worn by a user is within the teaching of this specification and the scope of the appended claims.

Figure 5B:
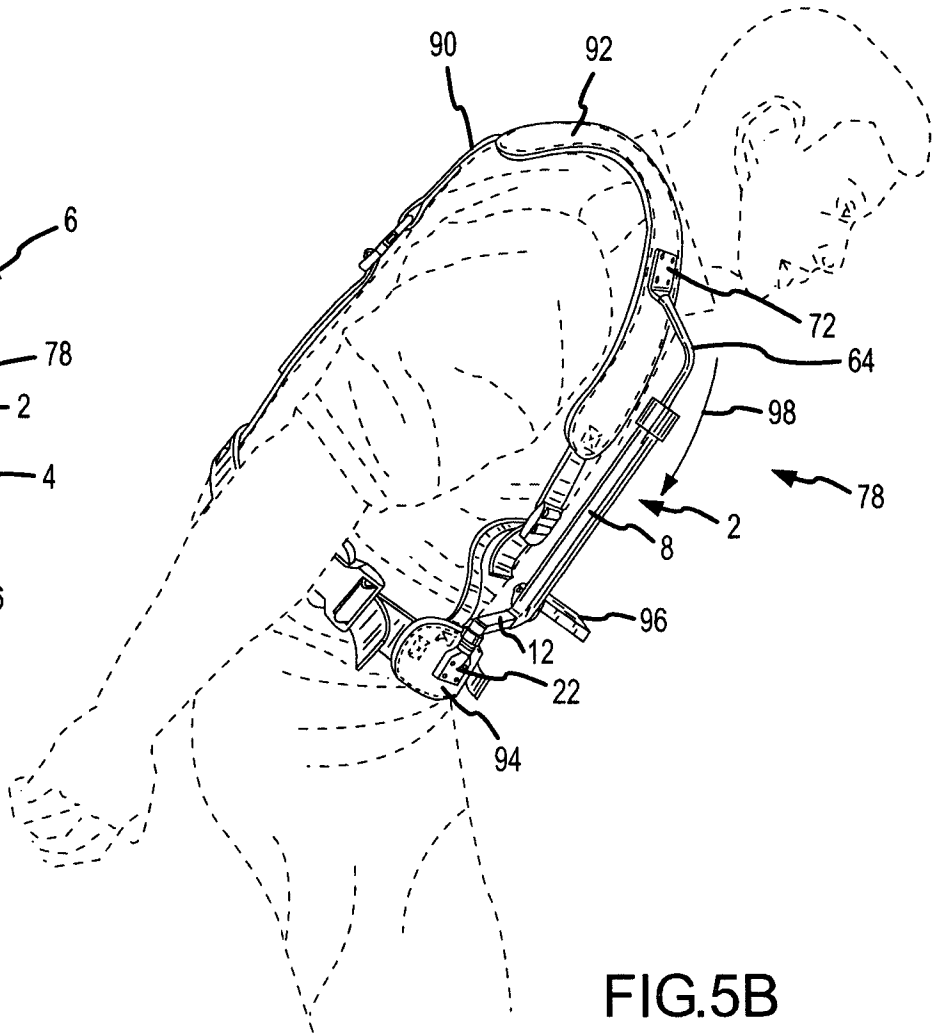
FIG. 5B is a reduced side view of the embodiment of FIG. 4A, showing the user (shown in phantom) bent forward at the waist, and showing that a telescopic accommodation mechanism of the frame has accommodated the decreased distance between the front of the user's hips and the front of the user's shoulders.

Moreover, the releasable connectivity of the frame 2 shown in FIGS. 1-4, while advantageous in many circumstances, is not a necessary or limiting factor of this specification or the appended claims. A frontpack frame 2 can be non-releasably attached to a harness worn by a user as shown in FIGS. 5A and 5B, for example, and still be within the teaching of this specification and the scope of the appended claims.

The frontpack system of FIGS. 1-4 can carry a wide range of shapes, sizes, and weights of articles (not shown) by securing such articles to the lower region 4 of the frame 2 using any suitable prior art or future holding apparatus (not shown).

Figure 5A:
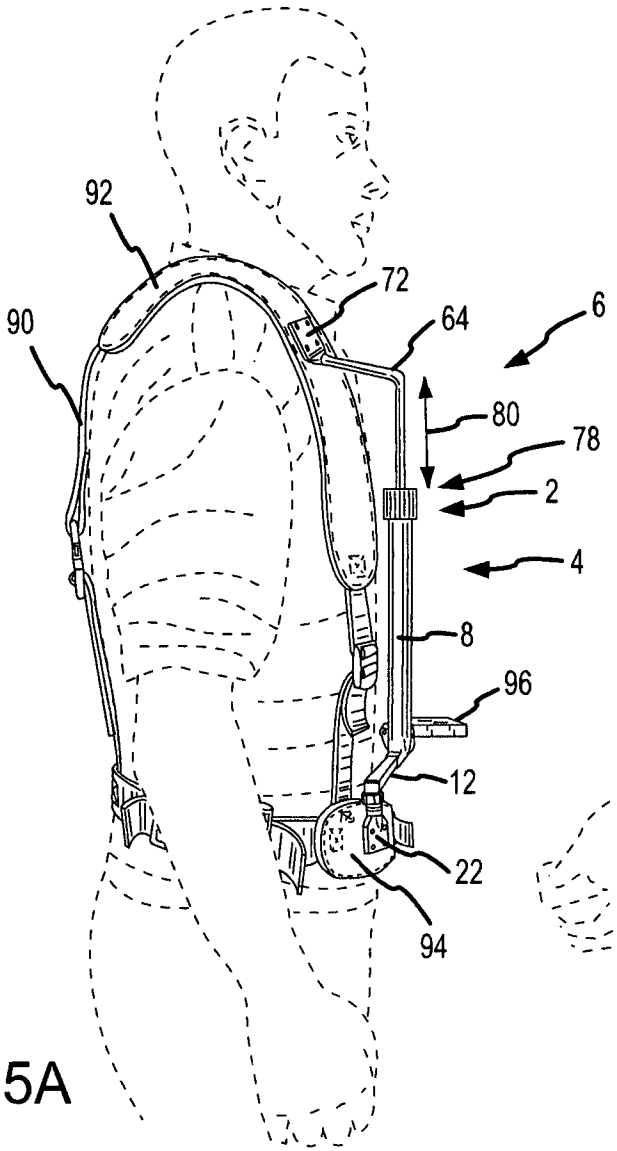
FIG. 5A is a reduced side view of an embodiment of a frontpack system comprising a frame connected to a harness, shown as it would appear if worn by a user (shown in phantom) in a normal upright posture.

Now referring to FIG. 5A, which illustrates another embodiment of the frontpack system, a frame 2 is attached to a harness 90 worn by a user (shown in phantom). The frame 2 is connected to at least one shoulder strap 92 by at least one upper connector 72, and is connected to at least one hip belt 94 by at least one lower connector 22.

The lower region 4 of the frame 2 comprises at least one lower section 8, which is sufficiently rigid to support the weight of at least one article secured upon the lower region 4 and to transfer the weight of the at least one article downward. The upper region 6 of the frame 2 comprises at least one upper section 64, which is sufficiently rigid to position and restrict the movement of the upper region 6 in relation to the at least one shoulder strap 92.

The at least one upper section 64 is inserted telescopically into the at least one lower section 8 to provide an accommodation mechanism 78. The at least one upper section 64 can slide up and down within the at least one lower section 8 in the vertical dimension as indicated by the arrow 80, thereby enabling the distance between the at least one lower connector 22 and the at least one upper connector 72 to change automatically in response to changes in the position of the user's torso during use of the system.

The lower region 4 comprises at least one horizontal section 12 that is connected to the at least one lower section 8. An article-supporting platform 96 is attached to and extends forward horizontally from the at least one horizontal section 12.

FIG. 5B shows the same embodiment of the frame 2 as shown in FIG. 5A, but FIG. 5B shows the torso of the user having moved from an upright position to a forward bending position as shown by arrow 98. The at least one upper section 64 has been automatically inserted deeper into the at least one lower section 8. This accommodation mechanism 78 has enabled the upper region 6 to move in relation to the lower region 4 such that the distance between the upper connector 72 and the lower connector 22 has changed automatically in response to changes in the position of the user's torso, as indicated by arrow 98.

As is shown by reference to FIGS. 5A and 5B, the frame 2 can be spaced apart from the front torso of the user. This spaced-apart configuration is due to a combination of the arcuate or angled shapes of the at least one horizontal section 12 and of the at least one upper section 64 and of the locations of attachment of the upper connector 72 and the lower connector 22 on the harness 90. The frame 2 is able to maintain this spaced-apart configuration because of the substantial rigidity of the lower region 4 and the upper region 6. Such spaced-apart separation of the frame 2 from the front torso of the user allows for ventilation of perspiration and prevents uncomfortable rubbing of the frame 2 against the torso of the user when the user moves or bends forward, as shown in FIG. 5B.

The generally rigid lower region 4 of the frame 2 efficiently transfers a substantial amount of the weight of any front-carried load vertically downward to the lower connector 22, and ultimately to the at least one hip belt 94 and to the user's hips. Further, the frame 2 can carry a wide range of shapes, sizes, and weights of articles (not shown) by securing such articles to the lower region 4 of the frame 2. Some articles may be additionally supported by resting upon the platform 96.

Figure 6A:
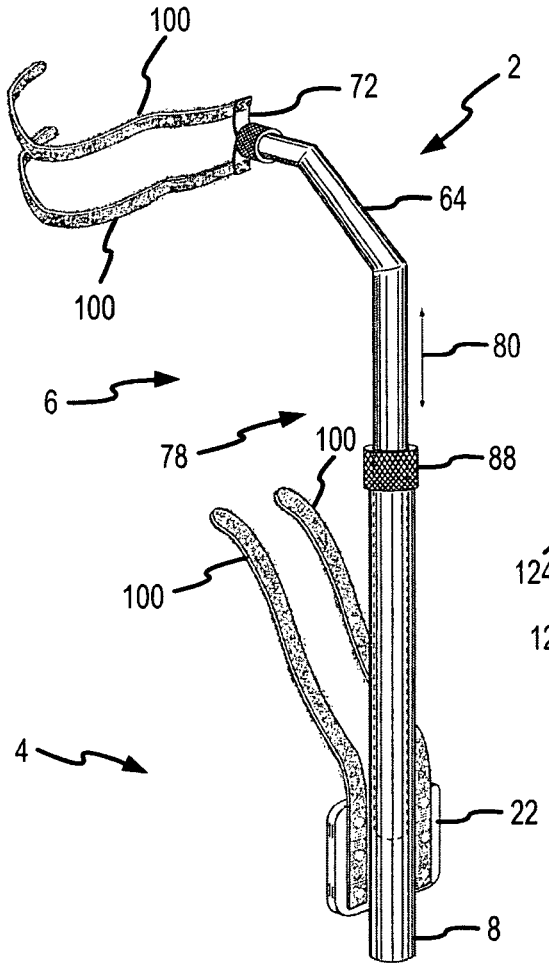
FIG. 6A is a perspective view of an embodiment of a frontpack system having one lower section, one lower connector, one upper section, one upper connector, and one accommodation mechanism.

The embodiment of FIGS. 5A and 6A uses a harness 90 in which at least one shoulder strap 92 and at least one hip belt 94 are connected by intermediate straps. This is not a necessary or limiting factor, however, as a harness constructed with a shoulder strap isolated and unconnected from the hip belt would be within the teaching of this specification and the scope of the appended claims.

The embodiment of FIGS. 5A and 5B utilizes a particular type of non-releasable connector system to connect the at least one lower connector 22 to the at least one hip belt 94 and the at least one upper connector 72 to the at least one shoulder strap 92. This is not a necessary or limiting factor, however, as the frame 2 could be connected to the harness 90 using any type of prior art or future connector system, including a releasable connector system, for example, as shown below in FIG. 17, and still be within the teaching of this specification and the scope of the appended claims.

The embodiment of FIGS. 5A and 5B uses an accommodation mechanism 78 comprising at least one inter-sliding assembly, namely, a telescopic assembly, but this is not a necessary or limiting factor of this specification or the appended claims. Any type of inter-sliding assembly or non-sliding mechanism that enables the distance between the at least one lower connector 22 and the at least one upper connector 72 to change automatically in response to changes in the position of the user's torso during use of the system is intended to be within the teaching of this specification and the scope of the appended claims.

Figure 6B:
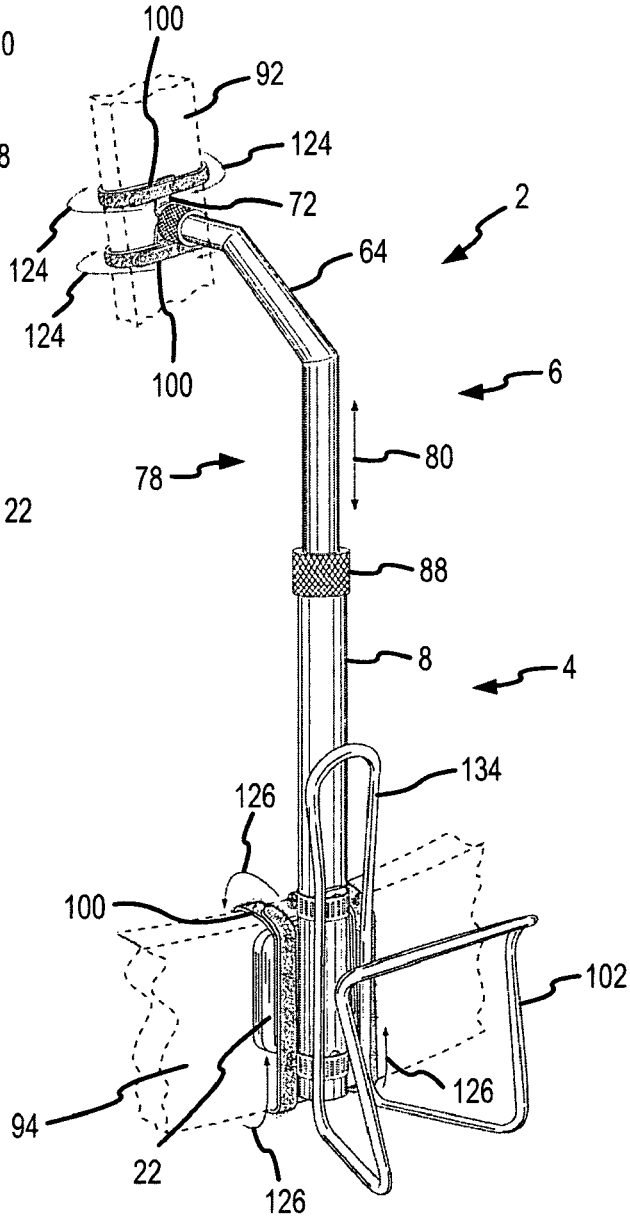
FIG. 6B is a perspective view of the embodiment of FIG. 6A with the upper connector connected to a shoulder strap (shown in phantom), the lower connector connected to a hip belt (shown in phantom), and a holder connected to the frame.

FIGS. 6A and 6B illustrate another embodiment of a front-pack system, in which a frame 2 comprises a lower region 4 having at least one lower section 8 and an upper region 6 having at least one upper section 64. The upper section 64 slides telescopically in the lower section 8 in the directions shown by arrows 80, so as to provide an accommodation mechanism 78. A retaining ring 88 retains a bushing (not shown) inserted in the lower end of the upper section 64 to prevent the upper section 64 from coming apart from the lower section 8.

The upper section 64 is bent at an angle toward at least one shoulder strap 92 (shown in phantom in FIG. 6B) worn by the user in order to position the frame 2 away from the torso of the user. The upper section 64 is substantially rigid so that it can position and restrict the movement of the upper region 6 in relation to the at least one shoulder strap 92.

The upper region 6 has at least one upper connector 72. In this embodiment the upper connector 72 is tab-like in shape. The upper connector 72 includes at least one strap 100, in this embodiment having hooks on one side and loops on the other, to releasably connect the upper connector 72 to the at least one shoulder strap 92 by wrapping the strap 100 in the direction of arrows 124, as shown in FIG. 6B.

The lower region 4 has at least one lower connector 22. In this embodiment the lower connector 22 is plate-like in shape. The lower connector 22 includes at least one strap 100, again in this embodiment having hooks on one side and loops on the other, to releasably connect the lower connector 22 to at least one hip belt 94 by wrapping the strap in the direction of arrows 126, as shown in FIG. 6B.

The lower section 8 is substantially rigid so that it can support the weight of at least one article secured upon the lower region 4 and transfer the weight of the at least one article downward. By way of example but not limitation, FIG. 6B shows the lower section 8 supporting an article securing mechanism 102, here a holder 134 for a water bottle or other cylindrical article.

In the embodiment shown in FIGS. 6A and 6B, the lower section 8, upper section 64, accommodation mechanism 78, lower connector 22, and upper connector 72 are all oriented in approximately the same vertical plane. This embodiment can be deployed at the front of the user's torso on either the right side, or the left side, or at approximately the vertical mid-line of the user's torso. It will also be readily understood that multiple instances of this embodiment of the system can be deployed simultaneously on the front torso of one user's body: for example, one system on the left side and one system on the right side of the body.

The embodiment of FIGS. 6A and 6B has an accommodation mechanism 78 comprising a certain type of inter-sliding assembly, namely a telescopic assembly, but this is not a necessary or limiting factor of this specification or the appended claims. Any type of inter-sliding assembly or non-sliding mechanism that enables the distance between the at least one lower connector 22 and the at least one upper connector 72 to change automatically in response to changes in the position of the user's torso during use of the system is intended to be within the teaching of this specification and the scope of the appended claims.

In the embodiment of FIGS. 6A and 6B, releasable connectivity to a harness 90 is achieved through the use hook-and-loop straps as a part of the lower 22 and upper 72 connectors. However, the use of a hook-and-loop strap connector system is not a necessary or limiting factor of this specification or the appended claims. The use of any type of a prior art or future releasable connector system to releasably connect the frontpack frame 2 to a harness worn by a user is within the teaching of this specification and the scope of the appended claims.

Moreover, the releasable connectivity of the frame 2 shown in FIGS. 6A and 6B is not a necessary or limiting factor of this specification or the appended claims. A frontpack frame 2 can be non-releasably attached to a harness worn by a user and still be within the teaching of this specification and the scope of the appended claims.

The embodiment of FIGS. 6A and 6B is shown with a particular type of article holder 134, but this is not a necessary or limiting factor of this specification or the appended claims. A frontpack system can use any type of prior art or future article securing mechanism 102 selected from the group consisting of, for example but not limited to, straps, buckles, and holders or some combination of these, and still be within the teaching of this specification and the scope of the appended claims.

Figure 7:
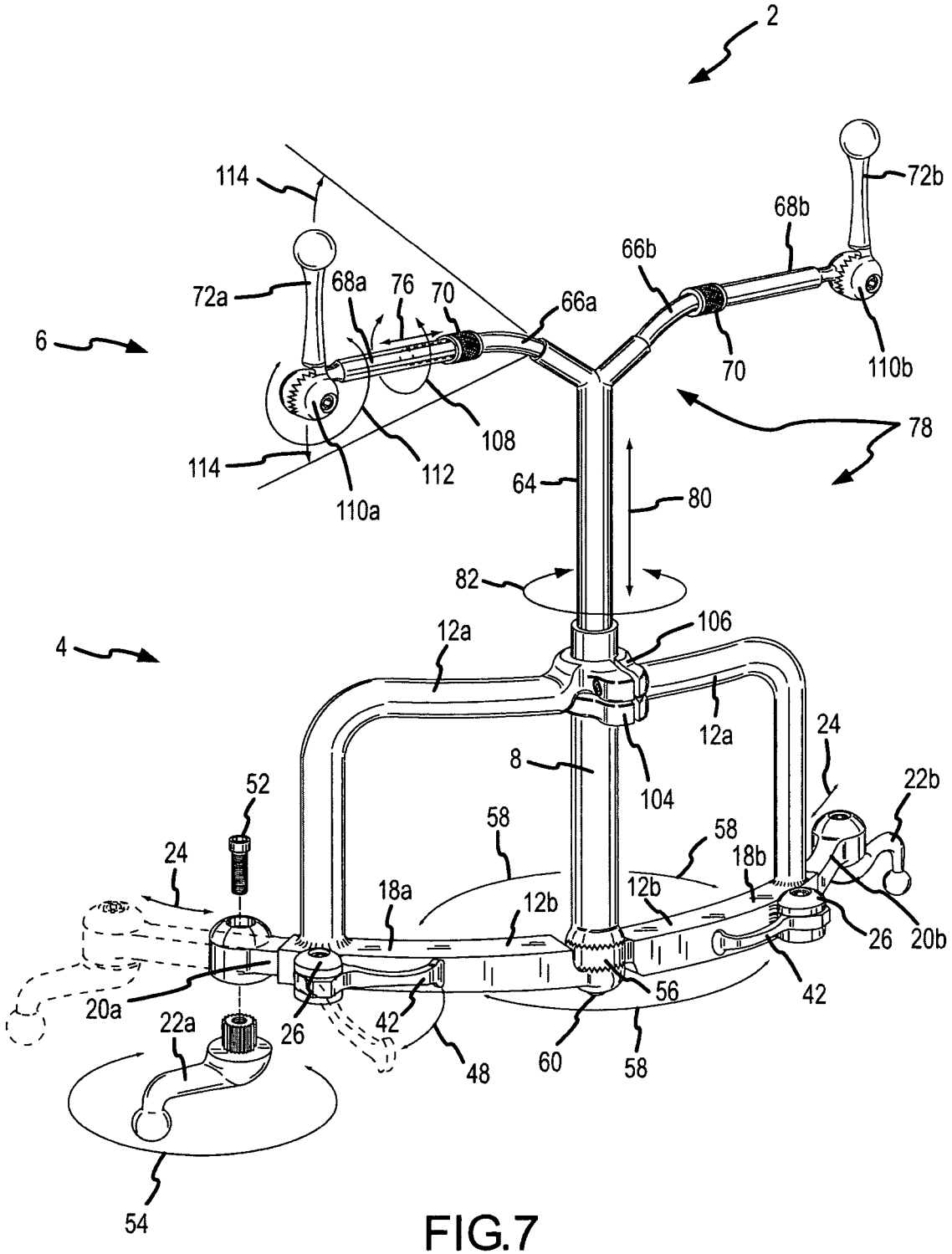
FIG. 7 shows a perspective view of an embodiment of a frontpack system having a lower section, an upper section, and an accommodation mechanism located at approximately the vertical center-line of the frame, and having other frame sections, lower connectors, and upper connectors located to the left and right of center.

FIG. 7 illustrates yet another embodiment of the frame 2 in which at least one lower section 8, at least one upper section 64, and an accommodation mechanism 78 are all located at approximately the vertical center-line of the frame 2, while other components of the lower region 6 and upper region 4 of the frame 2 are deployed to the left or to the right of center. This embodiment can be more comfortable for female users to wear as certain components of the frame 2 are positioned to avoid pressing upon the breasts, yet this embodiment also provides load-carrying capacity and stability comparable to the embodiment shown in FIG. 1 and discussed hereinabove.

In the embodiment of FIG. 7, the lower region 4 of the frame 2 comprises at least one lower section 8 oriented approximately vertically and located at approximately the vertical center-line of the frame 2. A lower horizontal section 12*b* is connected to the lower end of the lower section 8 and an upper horizontal section 12*a* is connected to the upper end of the lower section 8. The upper horizontal section 12*a* is configured such that its distal ends are bent down and connected to the distal ends of the lower horizontal section 12*b*, providing additional stability to the lower region 4 of the frame 2. The upper horizontal member 12*a* is bisected at its center and its proximal ends are formed into a bolted first clamping assembly 104 and bolted second clamping assembly 106, each of which releasably clamps upon the upper end of the lower section 8 and thereby connects the upper horizontal section 12*a* to the lower section 8.

In this embodiment, the curved lower horizontal section 12*b* is similar to the curved lower horizontal section 12*b* described for the embodiment illustrated in FIG. 1. A curved first horizontal section 18*a* and curved second horizontal section 18*b* are joined at their proximal ends by a serrated and bolted 60 pivot 56. The pivot 56 also forms the connection between the lower section 8 and the lower horizontal section 12*b*. When the bolt 60 in the pivot 56 is loosened and bolts (not shown) in the first clamping assembly 104 and second clamping assembly 106 are loosened, the entire lower region 4 of the frame 2 can be pivoted about the axis of the pivot 56 as shown by arrows 58, to adjust the lower region 4 to fit different sizes and shapes of lower torsos. These bolts are then tightened to secure the lower region 4 in its desired pivotal configuration.

A curved first horizontal adjustment section 20*a* and second horizontal adjustment section 20*b* are telescopically inserted into the first horizontal section 18*a* and second horizontal section 18*b*, respectively. At least one camming assembly 26 has a camming lever 42 attached to and lying over an opening (not shown) in the horizontal section 18. When the camming lever 42 is opened or closed in the direction shown by arrow 48, a curved interior surface (not shown) of the camming lever 42 disengages from or presses upon side of the horizontal adjustment section 20 through the opening (not shown) in the horizontal section 18. This inter-sliding adjustment mechanism enables the horizontal adjustment section 20 to be fixedly positioned and re-positioned in telescopic relation to the horizontal section 18 in the directions shown by arrows 24. This inter-sliding adjustment mechanism enables the lower region 4 of the frame 2 to be adjusted so that the distance between the first lower connector 22*a* and second lower connector 22*b* can be increased or decreased to fit users of different lower torso widths.

At least one splined lower connector 22 is connected to the distal end of the horizontal adjustment section 20 and is secured by a bolt 52. The semi-spherical end of the lower connector 22 can be rotationally positioned along an arc shown by arrow 54, to fit the lower region 4 to torsos of different widths and depths. The lower connector 22 can connect to and form a ball-and-socket joint with any prior art or future ball-and-socket connector assembly.

When the various camming assemblies and bolts of the lower region 4 are tightened, the lower region 4 is substantially rigid so that it transfers a substantial portion of the weight of the frame 2 and the front-carried load vertically downward to the frontal area of the user's hips. The rigid lower region 4 also assists in the controlling the frame 2 and any front-carried load against bouncing, swaying, and rocking when the user is moving or traveling.

In the embodiment of FIG. 7, the upper region 6 of the frame 2 has at least one upper section 64 that is oriented approximately vertically and is located at approximately the vertical center-line of the frame 2. The upper section 64 branches at its upper end into a "Y" shape, to one branch of which the first upper adjustment section 66*a* is attached, and to the other branch of which the second upper adjustment section 66*b* is attached. The first 66*a* and second 66*b* upper adjustment sections are telescopically inserted into the third 68*a* and fourth 68*b* upper adjustment sections, respectively, such that the third 68*a* and fourth 68*b* upper adjustment sections can be slidably positioned in relation to the first 66*a* and second 66*b* upper adjustment sections in the directions shown by arrows 76. In addition, the third 68*a* and fourth 68*b* upper adjustment sections can be rotatably positioned in relation to the first 66*a* and second 66*b* upper adjustment sections in the directions shown by arrows 108. The third 68*a* and fourth 68*b* upper adjustment sections are fixed in a desired position by locking rings 70.

Serrated and bolted upper pivots 110*a,b* connect the third 68*a* and fourth 68*b* upper adjustment sections to the upper connectors 72*a,b*, respectively, and enable the upper connectors 72*a,b* to be pivotally positioned in the directions shown by arrows 112. When first 66*a* and second 66*b* upper adjustment sections are made out of a flexible material, the uppermost components of the upper region 4 can flex in the directions shown by arrows 114 to provide an accommodation mechanism 78, as discussed below. However, the first 66*a* and second 66*b* upper adjustment sections and the other components of the upper region 6 are sufficiently rigid to position and restrict the movement of the upper region 6 in relation to at least one shoulder strap 92.

The upper connector 72 can connect to and form a ball-and-socket joint with the socket portion of any prior art or future ball-and-socket connector system mounted on the shoulder strap 92 and hip belt 94 of a harness 90, to releasably connect the frame 2 to the harness 90. However, the use of a ball-and-socket type of releasable connector system is not a necessary or limiting factor of this specification or the appended claims. The use of any type of a prior art or future releasable connector system to releasably connect the frontpack frame 2 to a harness 90 worn by a user is within the teaching of this specification and the scope of the appended claims.

Moreover, the releasable connectivity of the frame 2 shown in FIG. 8 is not a necessary or limiting factor of this specification or the appended claims. A frontpack frame 2 can be non-releasably attached to a harness 90 worn by a user and still be within the teaching of this specification and the scope of the appended claims.

The several adjustment mechanisms of the upper region 4 and lower region 6 in this embodiment allow the frame 2 to be adjusted to fit users with torsos of different sizes and shapes. Again, however, these adjustment mechanisms are not a necessary or limiting factor of this specification or the appended claims. A frontpack system could be constructed with less than all of these adjustment mechanisms, or with completely non-adjustable lower region 4 and upper region 6, and still be within the teaching of this specification and within the scope of the appended claims.

In the embodiment shown in FIG. 7, the accommodation mechanism 78 comprises at least one inter-sliding assembly, and more specifically a telescopic assembly, in which the upper section 64 slidably engages with the lower section 8 as shown by the arrows 80. This enables the upper region 6 to move in relation to the lower region 4 so that the distance between the at least one lower connector 22 and the at least one upper connector 72 can change automatically in response to changes in the position of the user's torso. As noted above, the accommodation mechanism 78 in this embodiment also comprises first 66*a* and second 66*b* upper adjustment sections that are made out of a flexible material. The first 66*a* and second 66*b* upper adjustment sections can flex as shown by arrows 114 and thereby enable the distance between the at least one lower connector 22 and the at least one upper connector 72 to change automatically in response to changes in the position of the user's torso. Because the first 66*a* and second 66*b* upper adjustment sections can flex independently, this feature of the accommodation mechanism 78 can operate asymmetrically to accommodate asymmetrical changes in the position of the user's torso.

The embodiment of FIG. 7 has an accommodation mechanism 78 comprising a certain type of inter-sliding assembly, namely a telescopic assembly, and comprising flexible sections of frame, but this is not a necessary or limiting factor of this specification or the appended claims. Any single mechanism or combination of mechanisms that enables the distance between the at least one lower connector 22 and the at least one upper connector 72 to change automatically in response to changes in the position of the user's torso during use of the system is intended to be within the teaching of this specification and the scope of the appended claims.

As with other embodiments, the system of FIG. 7 can hold and secure a wide variety of carried articles by using any suitable prior art or future article securing mechanism 102, for example but not limited to, a mechanism selected from the group consisting of straps, buckles, and holders, or some combination of these (not shown).

Figure 8A:
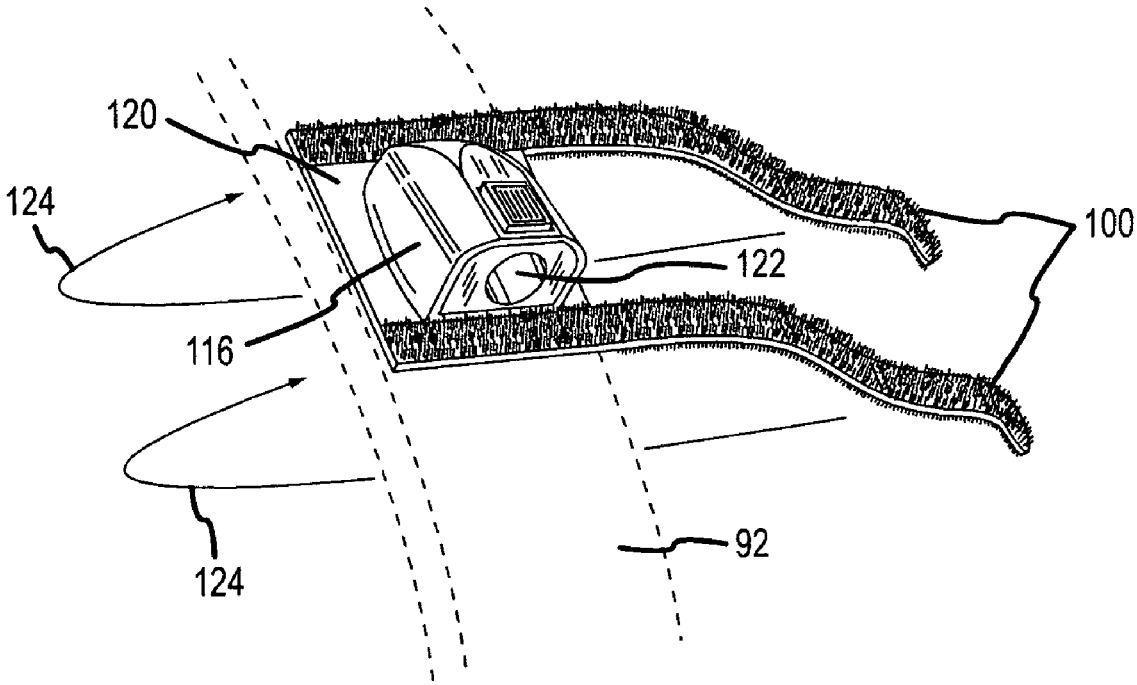
FIG. 8A shows a ball-and-socket type shoulder strap connector that can be attached with hook-and-loop straps to a shoulder strap (shown in phantom).
Figure 8B:
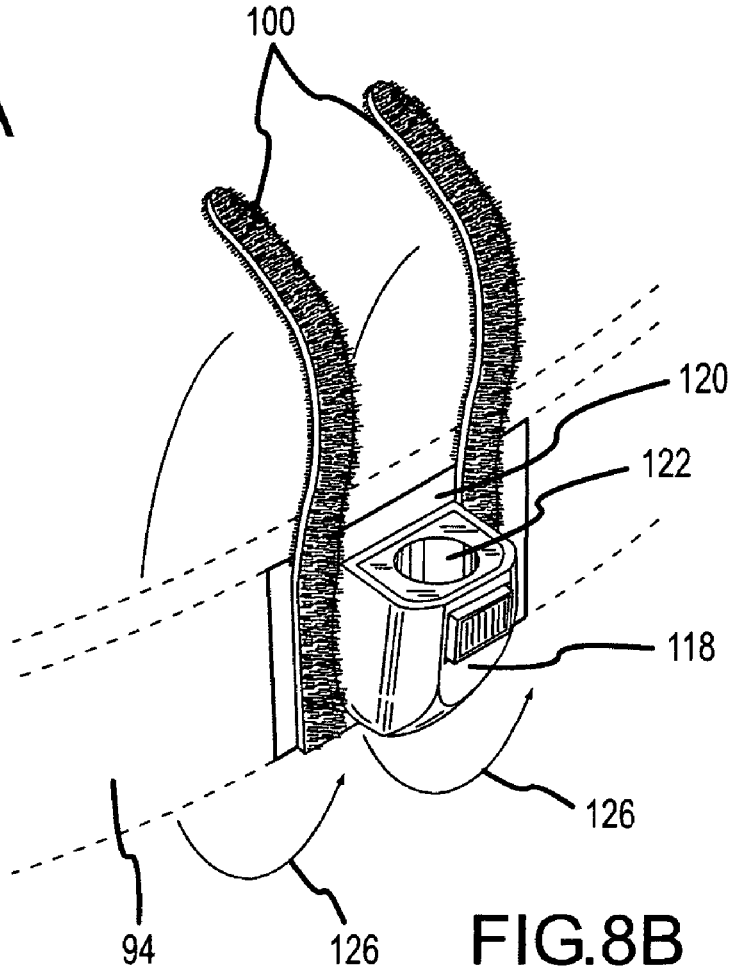
FIG. 8B shows a ball-and-socket type hip belt connector that can be attached with hook-and-loop straps to a hip belt (shown in phantom).

FIGS. 8A and 8B show a shoulder strap connector 116 and hip belt connector 118, respectively, for connecting a frame 2 such as is shown in FIGS. 1-3 and 7 to a shoulder strap 92 (shown in phantom) and hip belt 94 (shown in phantom), respectively, worn by a user. FIG. 8A shows a shoulder strap connector 116 having a mounting plate 120, a socket 122, and straps 100 for attaching the shoulder strap connector 116 to at least one shoulder strap 92 worn by a user. In this embodiment the straps 100 have hooks on one side and loops on another side such that the front side of each strap 100 will releasably stick to the back side. The shoulder strap connector 116 can thus be releasably attached to a shoulder strap 92 by wrapping the straps 100 as indicated by arrows 124. The socket 122 of the shoulder strap connector 116 can accept and form a ball-and-socket joint with the spherical portion of an upper connector 72 such as the upper connectors 72 of the frames 2 shown in FIGS. 1-3 and 7. The shoulder strap connector 116 has an internal latching mechanism (not shown) that can alternately capture and release the semi-spherical end of an upper connector 72, so as to alternately connect and disconnect the frame 2 to and from the shoulder strap connector 116. A self-latching, quick-releasing ball-and-socket connector mechanism is preferable for user convenience and safety, but any prior art or future releasable ball-and-socket latch mechanism can be used within the shoulder strap connector 116 to releasably attach a frame 2 to at least one shoulder strap 92.

FIG. 8B shows a hip belt connector 118 having a mounting plate 120, a socket 122, and straps 100 for attaching the hip belt connector 118 to at least one hip belt 94 worn by a user. In this embodiment the straps 100 have hooks on one side and loops on another side such that the front side of each strap 100 will releasably stick to the back side. The hip belt connector 118 can thus be releasably attached to a hip belt 94 by wrapping the straps 100 around the hip belt 94 as indicated by arrows 126. The socket 122 of the hip belt connector 118 can accept and form a ball-and-socket joint with the semi-spherical portion of a connector such as the at least one lower connector 22 of the frames 2 shown in FIGS. 1-3 and 7. The hip belt connector 118 has an internal latching mechanism (not shown) that can alternately capture and release the spherical end of the lower connector 22, so as to alternately connect and disconnect the frame 2 to and from the hip belt connector 118. Here again, a self-latching, quick-releasing ball-and-socket connector mechanism is preferable for user convenience and safety, but any prior art or future releasable ball-and-socket latch mechanism can be used within the hip belt connector 80 to releasably attach a frame 2 to a hip belt 94.

While FIGS. 8A and 8B show shoulder strap 116 and hip belt 118 connectors that are part of a ball-and-socket type releasable connector system, this is not a necessary or limiting factor of this specification or the appended claims. Shoulder strap 116 and hip belt 118 connectors could be part of a side-squeeze type of releasable connector system, or part of a buckle-and-tongue type of releasable connector system, or part of any other type of prior art or future releasable connector system, and still be within the teaching of this specification and the scope of the appended claims.

While FIGS. 8A and 8B show straps 100 having hook and loop surfaces, this is not a necessary or limiting factor of this specification or the appended claims. Shoulder strap 116 and hip belt 118 connectors could be releasably attached to the shoulder strap 92 and hip belt 94, respectively, using straps having conventional buckles, or they could be releasably or non-releasably attached to the shoulder strap 92 and hip belt 94 using any of myriad other types of prior art or future releasable or non-releasable attachment systems, and still be within the teaching of this specification and the scope of the appended claims.

Figure 9:
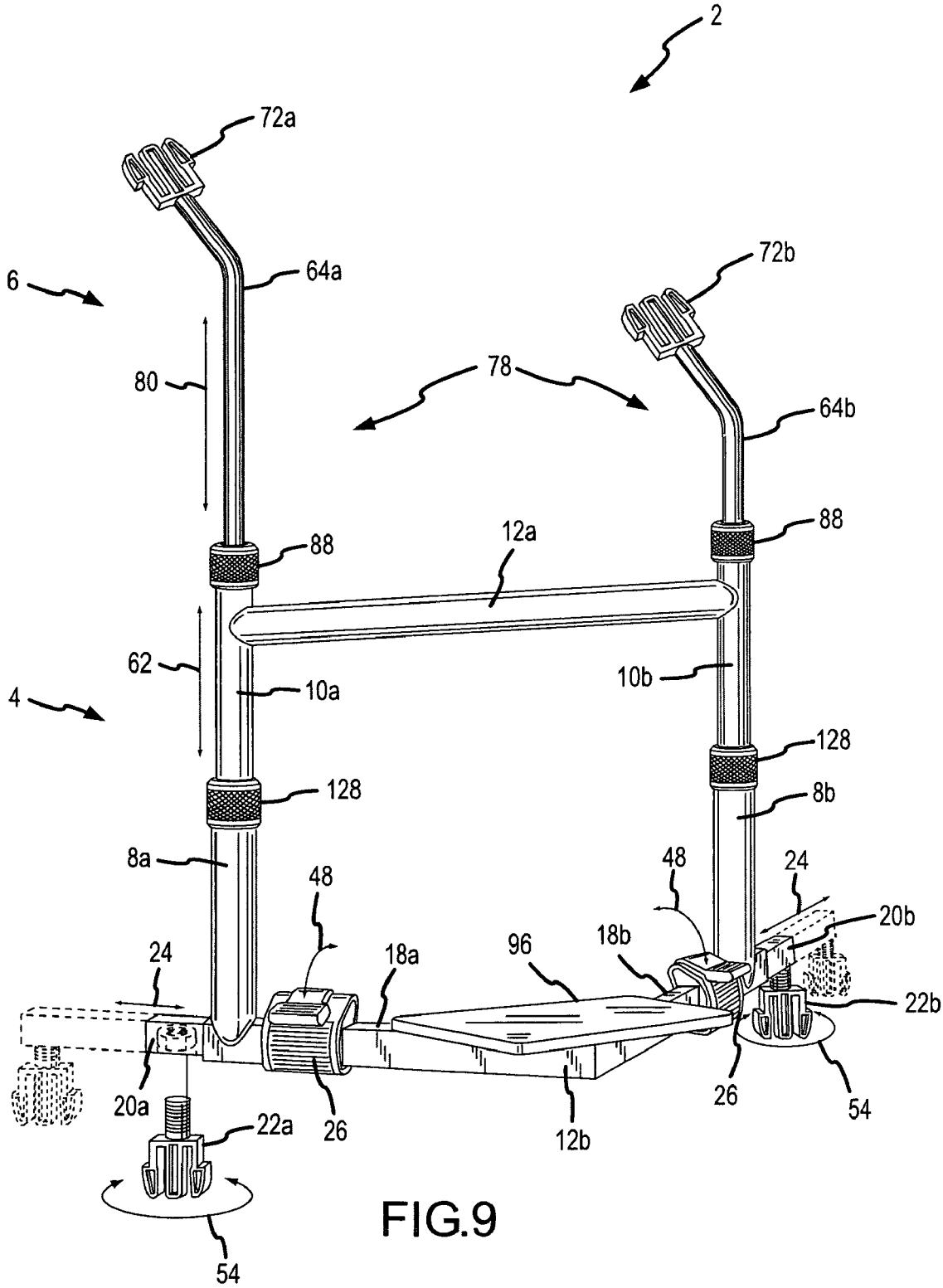
FIG. 9 shows a perspective view of an embodiment of a frontpack system comprising a frame with side-squeeze buckle type lower connectors and upper connectors that are not connected to a harness, but which are capable of being connected to a harness.

FIG. 9 discloses yet another embodiment of a frontpack system. In this embodiment the lower region 4 comprises a first lower section 8*a* and a second lower section 8*b*, and at least one horizontal section 12*b* extending between the first lower section 8*a* and the second lower section 8*b*. The angled lower horizontal section 12*b* can be formed as a single angled section or as a combination of a straight first horizontal section 18*a* and a straight second horizontal section 18*b*, as shown in FIG. 9. The angled lower horizontal section 12*b* supports a platform 96 for supporting and carrying a wide range of shapes, sizes, and weights of articles. A first 20*a* and a second 20*b* horizontal adjustment sections are telescopically inserted into the lower horizontal member 12*b*.

Figure 17:
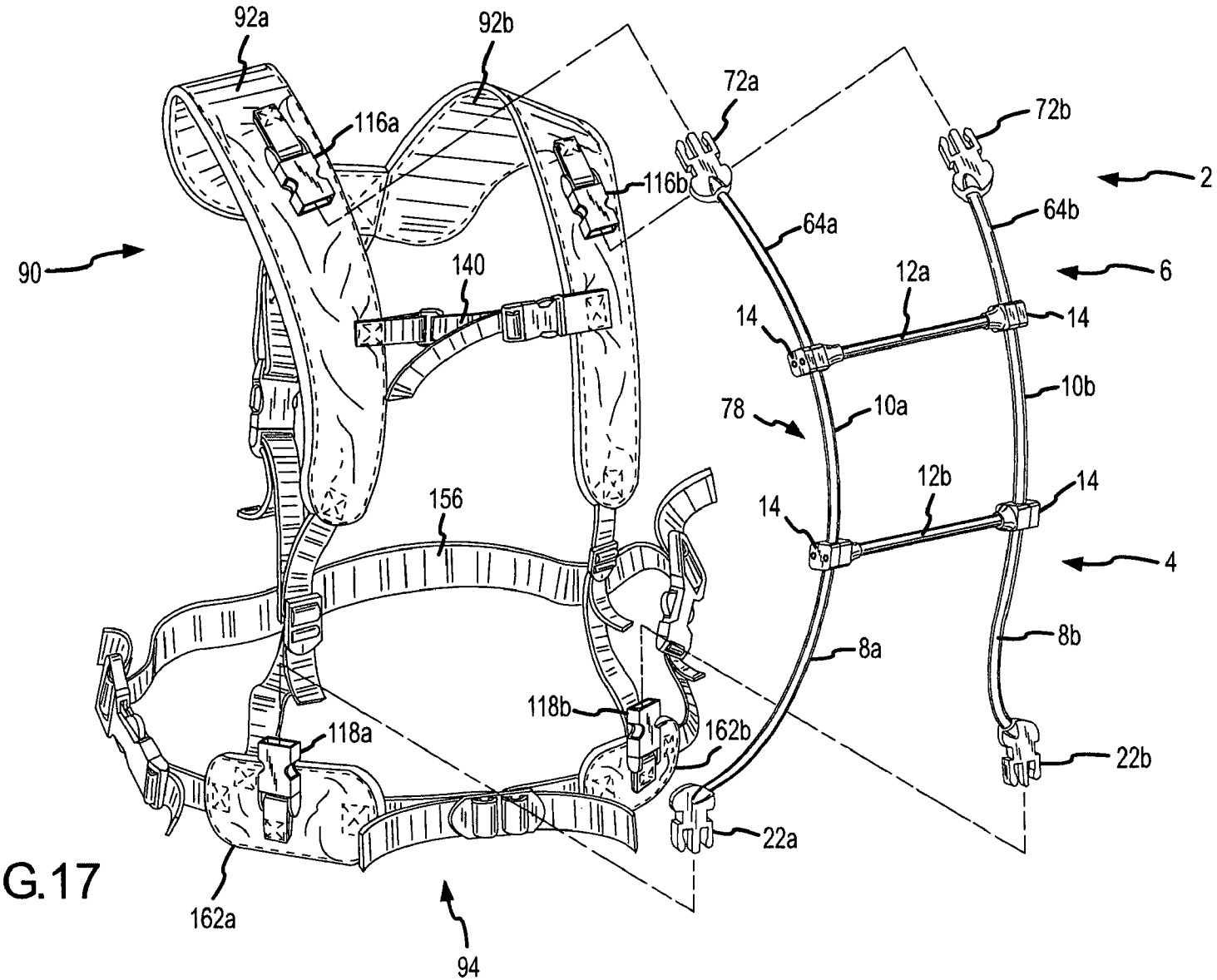
FIG. 17 shows a perspective view of a frontpack system comprising a frame with an accommodation mechanism that comprises flexible frame members, a harness shown in separated relationship to the frame, and side-squeeze buckle type connectors to releasably connect the frame to the harness.

The lower region 4 has first 22*a* and second 22*b* lower connectors that are attached to the distal ends of first 20*a* and second 20*b* horizontal adjustment sections. In this embodiment each lower connector 22*a,b* is a side-squeeze buckle type releasable connector that connects to, for example, a hip belt connector 118 such as is shown in FIGS. 11B and 17, and thereby connects the lower region 4 of the frame 2 to at least one hip belt 94. The lower connectors 22*a,b* can be rotated as shown by arrow 54 to achieve a proper angle for insertion into such a hip belt connector 118.

The first 20*a* and second 20*b* horizontal adjustment sections slide in and out within the lower horizontal member 12*b* in the dimension shown by arrows 24. Typical horizontal extensions of the first 20*a* and second 20*b* horizontal adjustment sections are shown in phantom. The first 20*a* and second 20*b* horizontal adjustment sections are held in a desired position by camming assemblies 26, which releasably clamp upon the first 20*a* and second 20*b* horizontal adjustment sections through openings (not shown) in the lower horizontal member 12*b*. This inter-sliding adjustment mechanism enables the lower region 4 of the frame 2 to be adjusted so that the distance between the first lower connector 22*a* and second lower connector 22*b* can be increased or decreased to fit users of different lower torso widths.

As further shown in FIG. 9, third 10*a* and fourth 10*b* lower sections are telescopically inserted into the first 8*a* and second 8*b* lower sections, respectively, and an upper horizontal section 12*a* extends between the third 10*a* and the fourth 10*b* lower sections. The upper horizontal section 12*a*, third lower section 10*a*, and fourth lower section 10*b* can be raised and lowered as a unitary assembly in the vertical dimension as shown by arrows 62 to a desired elevation, thereby adjusting the vertical length of the lower region 4 of the frame 2 to fit torsos of different vertical lengths. Locking rings 128 secure the third 10*a* and fourth 10*b* lower sections in the desired position. When the locking rings 128 are tightened and the camming assemblies 26 are closed, the lower region 4 of the frame 2 is sufficiently rigid to support the weight of at least one article secured upon the lower region and to transfer the weight of the at least one article downward. The rigid lower region also aids in controlling the frame and any front-carried load against bouncing, swaying, and rocking when the user is moving.

In this embodiment, the upper region 6 comprises first 64*a* and second 64*b* upper sections, which are telescopically inserted into the third 10*a* and fourth 10*b* lower sections, respectively. The first 64*a* and second 64*b* upper sections are bent toward the shoulders of the user to space apart the upper region 6 from the upper torso of the user. At least one upper connector 72 is attached to the upper region 6. In this embodiment the upper connector 72 is a side-squeeze buckle type of releasable connector to connect the upper region 6 to a shoulder strap connector system such as, for example, the shoulder strap connector 116 shown in FIGS. 11A and 17, thereby connecting the upper region 6 of the frame 2 to at least one shoulder strap 92. The upper region 6 is sufficiently rigid to position and restrict the movement of the upper region 6 in relation to the at least one shoulder strap.

FIG. 9 shows at least one accommodation mechanism 78 comprising at least one inter-sliding assembly, specifically the telescopic assemblies of first 64*a* and second 64*b* upper sections inserted into the third 10*a* and fourth 10*b* lower sections, respectively. The accommodation mechanism 78 enables the upper region 6 to move in relation to the lower region 4 in the directions shown by arrows 80. This enables the distance between the at least one lower connector 22 and the at least one upper connector 72 to change automatically in response to changes in the position of the user's torso.

Figure 10:
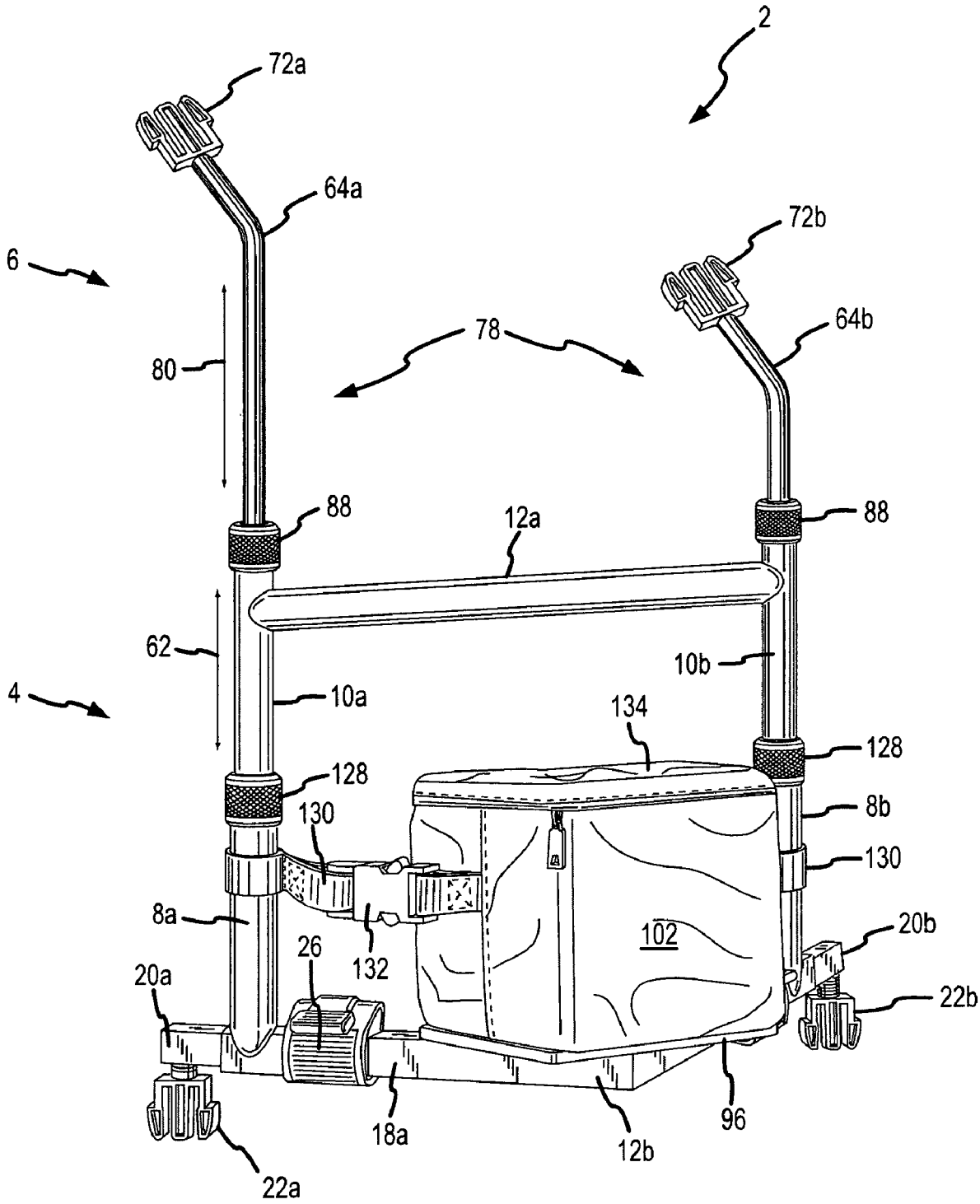
FIG. 10 is a perspective view of the frontpack system of FIG. 9, illustrating an article securing mechanism for securing a holder such as a pack bag.

The frame 2 shown in FIG. 9 can carry a wide range of sizes, shapes, and weights of articles. For example, FIG. 10 shows the same embodiment disclosed in FIG. 9, but including an article securing mechanism 102 comprising straps 130, buckles 132, and a holder 134 (a pack bag). This particular article securing mechanism 102 is not, however, a necessary or limiting factor of this specification or the appended claims. A frontpack system could be constructed with any type of prior art or future article securing mechanism 102, or none at all, and still be within the teaching of this specification and the appended claims.

While the support platform 96 the system shown in FIGS. 9 and 10 can be useful for supporting carried articles, this is also not a necessary or limiting factor in this specification or the appended claims. A frontpack frame 2 could be constructed without any horizontal support structure and still be within the teaching of this specification and the scope of the appended claims.

In the embodiment of FIGS. 9 and 10, the adjustment mechanisms in the lower region 4 of the frame 2 also are not a necessary or limiting factor of this specification or the appended claims. A frontpack system could be constructed with less than all of these adjustment mechanisms, or with a completely non-adjustable lower region 4, and still be within the teaching of this specification and within the scope of the appended claims.

The embodiment of FIGS. 9 and 10 has an accommodation mechanism 78 comprising a certain type of inter-sliding assembly, namely a telescopic assembly, but this is not a necessary or limiting factor of this specification or the appended claims. Any type of mechanism that enables the distance between the at least one lower connector 22 and the at least one upper connector 72 to change automatically in response to changes in the position of the user's torso during use of the system is intended to be within the teaching of this specification and the scope of the appended claims.

In the embodiment of FIGS. 9 and 10, releasable connectivity to a harness 90 (not shown) is achieved through the use of side-squeeze buckle type lower 22 and upper 72 connectors, but this is not a necessary or limiting factor of this specification or the appended claims. The use of any type of prior art or future releasable connector system to releasably connect the frontpack frame 2 to a harness worn by a user is within the teaching of this specification and the scope of the appended claims.

Moreover, the releasable connectivity of the frame 2 shown in FIGS. 9 and 10 is not a necessary or limiting factor of this specification or the appended claims. A frontpack frame 2 can be non-releasably attached to a harness 90 worn by a user and still be within the teaching of this specification and the scope of the appended claims.

Figure 11A:
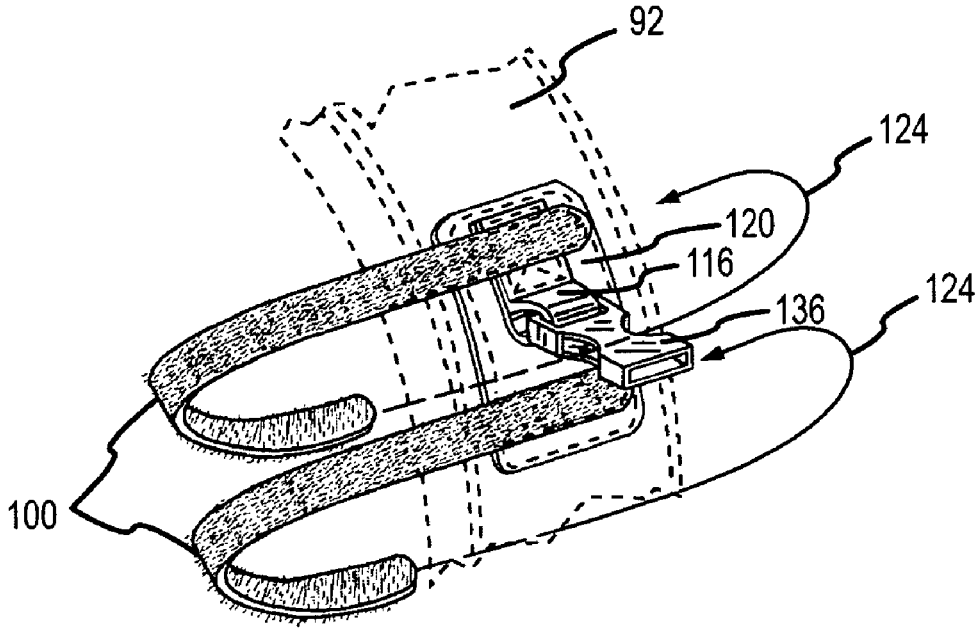
FIG. 11A shows a side-squeeze buckle type shoulder strap connector that can be attached with hook-and-loop straps to a shoulder strap (shown in phantom).
Figure 11B:
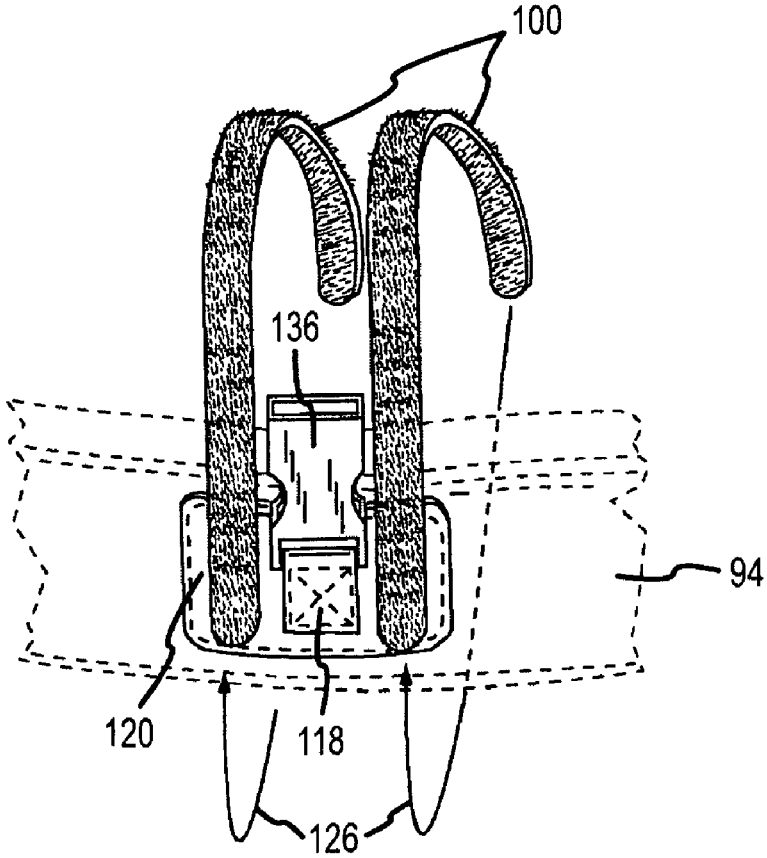
FIG. 11B shows a side-squeeze buckle type hip belt connector that can be attached with hook-and-loop straps to a hip belt (shown in phantom).

FIGS. 11A and 11B show a shoulder strap connector 116 and hip belt connector 118, respectively, for connecting a frame 2 to a shoulder strap 92 and hip belt 94, respectively, worn by a user. FIG. 11A shows a shoulder strap connector 116 having a mounting plate 120, buckle 136, and straps 100 for attaching the shoulder strap connector 116 to at least one shoulder strap 92. In this embodiment the straps 100 have hooks on one side and loops on another side such that the front side of each strap 100 will releasably stick to the back side. The shoulder strap connector 116 can thus be releasably attached to a shoulder strap 92 by wrapping the straps 100 as indicated by arrows 124. In this embodiment the buckle 136 is a side-squeeze type of releasable buckle that can accept and releasably connect with a mating connector such as at least one upper connector 72 of the frame 2 shown in FIGS. 9-10 or the frame 2 shown in FIG. 17.

FIG. 11B shows a hip belt connector 118 having a mounting plate 120, buckle 136, and straps 100 for attaching the hip belt connector 118 to at least one hip belt 94 worn by a user. In this embodiment the straps 100 have hooks on one side and loops on another side, for removably and relocatably attaching the hip belt connector 118 to a hip belt 94 by wrapping the straps 100 as indicated by arrows 126. In this embodiment the buckle 136 is a side-squeeze type of releasable buckle that can accept and releasably connect with a mating connector such as at least one lower connector 22 of the frame 2 shown in FIGS. 9-10 or the frame 2 shown in FIG. 17.

While FIGS. 11A and 11B show shoulder strap 116 and hip belt 118 connectors that are part of a side-squeeze buckle type of releasable connector system, this is not a necessary or limiting factor of this specification or the appended claims. Shoulder strap 116 and hip belt 118 connectors could be part of a ball-and-socket type of releasable connector system, or part of a buckle-and-tongue type of releasable connector system, or part of any other type of prior art or future releasable connector system, and still be within the teaching of this specification and the scope of the appended claims.

While FIGS. 11A and 11B show straps 100 having hook and loop surfaces, this is not a necessary or limiting factor of this specification or the appended claims. Shoulder strap 116 and hip belt 118 connectors could be releasably attached to the shoulder strap 92 and hip belt 94, respectively, using straps having conventional buckles, or they could be releasably or non-releasably attached to the shoulder strap 92 and hip belt 94 using any of myriad other types of prior art or future releasable or non-releasable attachment systems, and still be within the teaching of this specification and the scope of the appended claims.

Figure 12:
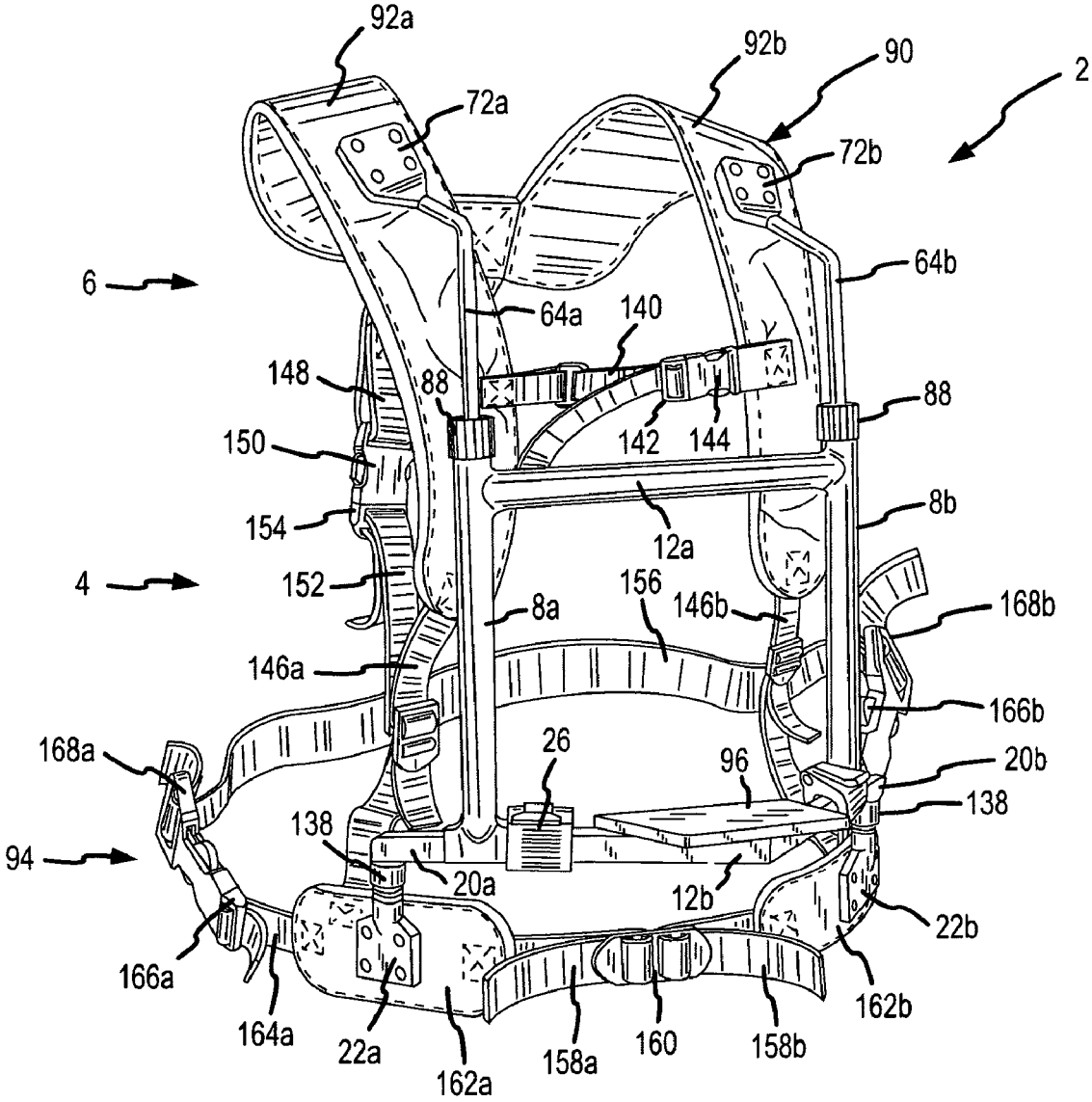
FIG. 12 shows a perspective view of an embodiment of a frontpack system having a frame connected to a harness.

FIG. 12 illustrates an embodiment also shown in FIGS. 5A and 5B in which a frame 2 is connected to an integrated harness 90. In this embodiment, the upper 12*a* and lower 12*b* horizontal sections extend between the first lower section 8*a* and the second lower section 8*b*. The lower region 4 comprises the first 8*a* and second 8*b* lower sections, upper horizontal section 12*a*, and lower horizontal section 12*b*. The lower region 4 of the frame 2 is sufficiently rigid to support the weight of at least one article secured upon the lower region 4 and to transfer the weight of the at least one article downward.

The lower horizontal section 12*b*, which may be formed from a single section or from a combination of joined sections as described above, carries a platform 96 for supporting and carrying a wide range of shapes, sizes, and weights of articles. The lower horizontal section 12*b* is hollow at both ends, and has first 20*a* and second 20*b* horizontal adjustment sections residing within the respective open hollow ends. Each horizontal adjustment section 20*a*, 20*b* is positioned by inserting it to a desired depth within the lower horizontal section 12*b*, and is fixed in place by at least one conventional camming assembly 26. This inter-sliding adjustment mechanism enables the lower region 4 of the frame 2 to be adjusted so that the distance between the first lower connector 22*a* and second lower connector 22*b* can be increased or decreased to fit users of different lower torso widths.

The lower region 4 has at least one lower connector 22 to connect the lower region to at least one hip belt 94. In this embodiment, the at least one lower connector 22 is attached to the lower region 4 by use of a threaded sleeve 138 which allows the lower connector 22 to rotate to fit the curvature of the user's lower torso. The lower connector 22 is tab-shaped and is connected to the at least one hip belt 94 by multiple rivets. Again, other equivalent and future equivalent connectors and connector systems may be used for this purpose.

The first 8*a* and second 8*b* lower sections are hollow and have retaining rings 88 connected to their upper ends. The retaining rings 88 prevent the escape of the first 64*a* and second 64*b* upper sections, which slide telescopically within the first 8*a* and second 8*b* lower sections, respectively, as detailed above for FIGS. 1-3.

The upper region 6 has at least one upper connector 72 to connect the upper region 6 to at least one shoulder strap 92. In this embodiment, the at least one upper connector 72 is tab-shaped and is non-removably connected to the at least one shoulder strap 92 by multiple rivets, although other equivalent and future equivalent connectors and connector systems may be used for this purpose. The upper region 6 of the frame 6 is sufficiently rigid to position and restrict the movement of the upper region in relation to the at least one shoulder strap 92.

The integrated harness 90 includes at least one shoulder strap 92, in this embodiment padded left and right shoulder straps 92*a,b* designed to be draped over the shoulders of a user. A sternum strap 140 is secured at about the mid-front portion of the right shoulder strap 92*a*, terminating in a first buckle portion 142. A second buckle portion 144 is secured at about the mid-front portion of the left shoulder strap 92*b* to receive first buckle portion 142. A pair of shoulder adjustment straps 146*a,b* are attached to and descend from the shoulder straps 92*a,b*, with each connecting at spaced-apart locations with the front of the at least one hip belt 94.

A main back strap 148 attaches to and descends from the upper ends of the shoulder straps 92*a,b*, and terminates in a third buckle portion 150. A back adjustment strap 152 is attached to and ascends upwardly from about the center of the rear hip strap 156 component of the hip belt 94. The length of the back adjustment strap 152 is adjustable, and it terminates at its upper end in fourth buckle portion 154. The fourth buckle portion 154 is designed to connect to and release from third buckle portion 150 attached to the lower end of the main back strap 148.

The at least one hip belt 94 comprises flexible left and right front straps 158*a,b* that meet at, and are adjustable at, a substantially central front buckle 160. The distal ends of the left and right front straps 158*a,b* connect to left and right hip pads 162*a,b*, which support the lower connectors 22*a,b* of the frame 2 and protect the user's lower torso. As additional parts of the at least one hip belt 94, flexible left 164*a* and right 164*b* (not shown) side straps extend from the hip pads 162*a,b* circumferentially and terminate in left and right fifth buckle portions 166*a,b*. To complete the at least one hip belt 94, a flexible rear hip strap 156 is deployed around the back of the user's hips and terminates at its left and right ends in left and right sixth buckle portions 168*a,b*. The sixth buckle portions 168 are designed to easily connect to and release from the fifth buckle portions 166 to complete the at least one hip belt 94 and give the user access into and out of the integrated harness 90 from either the left or the right side.

In the embodiment of FIG. 12, the at least one upper section 64 is inserted telescopically into the at least one lower section 8 to provide an inter-sliding accommodation mechanism 78. As was discussed above in greater detail in connection with FIGS. 5A and 5B, the at least one upper section 64 can slide up and down within the at least one lower section 8, thereby enabling the distance between the at least one lower connector 22 and the at least one upper connector 72 to change automatically in response to changes in the position of the user's torso during use of the system.

Referring again to FIG. 12, it can be seen that the shoulder adjustment straps 146 and back adjustment strap 152 of the harness 90 are adjustable so that the frontal areas of the shoulder straps 92 and hip belt 94 can be raised or lowered upon the torso of the user. The front straps 158, side straps 164, and rear hip strap 156 can be adjusted to fit torsos of different girths. The lower region 4 of the frame 2 can be adjusted to fit users with lower torsos of differing widths. Horizontal adjustment sections 20*a,b* can be positioned within the angled lower horizontal section 12*b* and fixed in place with camming assemblies 26. This inter-sliding adjustment mechanism allows the distance between the first lower connector 22*a* and second lower connector 22*b* to be adjusted. The lower connectors 22 can also be rotated within the threaded sleeves 138 until the horizontal angle of each lower connector 22 matches the curvature of the user at that location.

It is clearly shown that, using the several adjustment mechanisms of the frame 2 and the adjustment elements of the integrated harness 90, the combined frame 2 and harness 90 are comfortably fitted to the torso of the user. However, these adjustment features are not a necessary or limiting factor in this specification or the appended claims. A frontpack system could be constructed with less than all of these adjustment features, or none at all, and still be within the teaching of this specification and the scope of the appended claims.

The lower region 4 of the frame 2 and hip belt 94 transmit a substantial portion of the weight of the frame 2 and any front-carried load downward to the frontal area of the hips of the user. The rigid lower region 4 also aids in controlling the frontpack and any front-carried load against bouncing, swaying, and rocking.

The frontpack system of FIG. 12 can carry a wide range of shapes, sizes, and weights of articles by securing such articles to the lower region 4 of the frame 2 using any suitable prior art or future article securing mechanism, such as, for example but not limited to, a strap, buckle, or holder (not shown).

The harness 90 of FIG. 12 is shown as being composed of over a dozen segments, four releasable buckle systems, and eleven strap adjustment elements, but this is not a necessary or limiting factor in this specification or the appended claims. The harness 90 could be composed of less or more segments, buckles, and adjustment elements and still be within the teaching of this specification and the scope of the appended claims. While the shoulder straps 92 and hip belt 94 are shown as being connected to one another by various intermediate straps, the harness 90 could be constructed of shoulder straps 92 and a hip belt 94 that are isolated and unconnected. While certain parts of the harness 90, specifically the shoulder straps 92*a,b* and hip pads 162*a,b*, are shown to be made of more robust and padded material, that is also not a necessary feature or limiting factor in the harness 90. While the buckle systems of integrated harness 90 are shown as side-squeeze type releasable buckles, any prior at or future equivalent buckle systems or releasable connector system may be substituted for these buckle systems without affecting the basic operations of the harness 90.

As discussed above, the embodiment of FIG. 12 has an accommodation mechanism 78 comprising certain type of inter-sliding assembly, namely a telescopic assembly, but this is not a necessary or limiting factor of this specification or the appended claims. Any type of inter-sliding assembly or non-sliding mechanism that enables the distance between the at least one lower connector 22 and the at least one upper connector 72 to change automatically in response to changes in the position of the user's torso during use of the system is intended to be within the teaching of this specification and the scope of the appended claims.

In the embodiment of FIG. 12, the frame 2 is shown as being non-releasably connected to the harness 90 by rivets, but this is also not a necessary or limiting factor of this specification or the appended claims. The frame 2 could be connected to the harness 90 by any prior art or future non-releasable connector system, or by any type of a prior art or future releasable connector system, and still be within the teaching of this specification and the scope of the appended claims.

Figure 13:
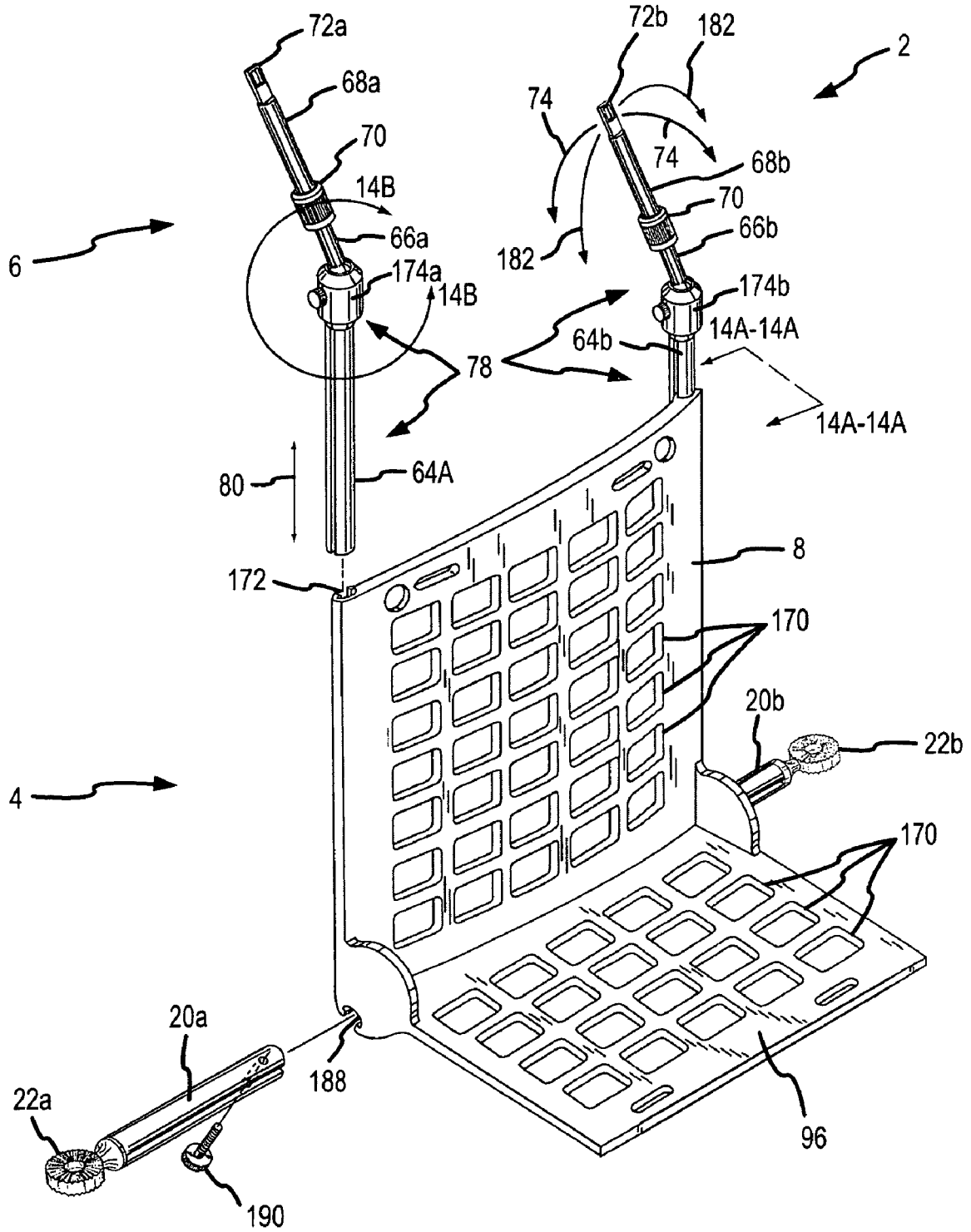
FIG. 13 is a partially exploded perspective view of an embodiment of a frontpack system having a frame with a planar lower section and an accommodation mechanism that comprises sliding dovetail joints and ball joints.

FIG. 13 discloses another embodiment of a frontpack system, in which the frame 2 has a lower region 4 comprising at least one lower section 8 and a platform 96, which is integrally connected to the at least one lower section 8 and which extends horizontally away from the front torso of a user when the frame 2 is worn by the user. The at least one lower section 8 and the platform 96 both have a matrix of openings 170 and can be formed in a casting, molding, milling, stamping, or similar process. The lower region 4 is sufficiently rigid to transfer a substantial portion of the weight of the frontpack and the front-carried load downward. FIG. 13 shows a particular configuration of openings 170 that are circular, slotted, and rectangular, but it is understood that myriad shapes, sizes, and locations of openings 170 can be utilized depending upon the specific intended uses of the frame 2, or the frame 2 can be constructed without openings, and still be within the teaching of this specification and the scope of the appended claims.

The upper region 6 of the frame 2 comprises at least one upper section 64 that is sufficiently rigid to position and restrict the movement of the upper region 6 in relation to at least one shoulder strap 92. In this embodiment, the upper region 6 comprises a first upper section 64*a* and a second upper section 64*b*, which are inserted into channels 172 in the at least one lower section 8. The first 64*a* and second 64*b* upper sections have dovetail-shaped cross-sections that mate with the dovetail-shaped cross-sections of the channels 172 in the lower section 8, as further illustrated in FIG. 14A. The mating dovetail-shaped cross-sections allow the first 64*a* and second 64*b* upper sections to slide freely up and down in relation to the lower section 8 as shown by arrow 80 to provide an accommodation mechanism 78.

Figure 14A:
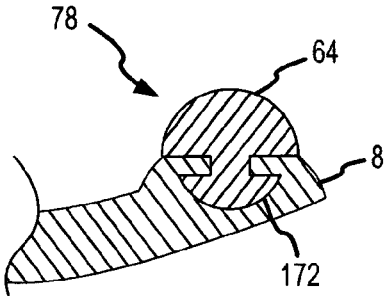
FIG. 14A shows an enlarged cross-sectional view along lines 14A-14A of FIG. 13 of the sliding dovetail joints of the accommodation mechanism of FIG. 13.
Figure 14B:
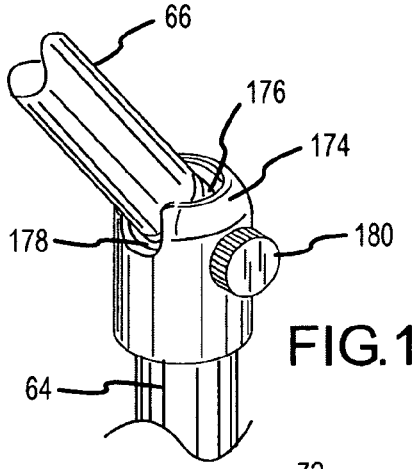
FIG. 14B shows an enlarged rear view of the ball joints of the accommodation mechanism of FIG. 13.
Figure 14C:
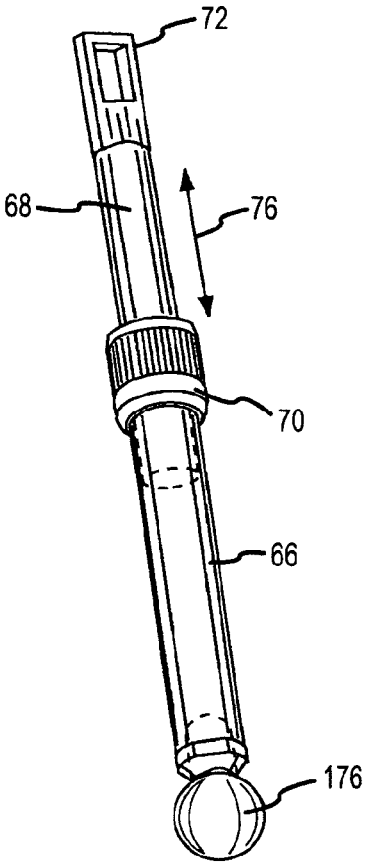
FIG. 14C shows an enlarged view of the length adjustment mechanism in the upper region of the frame of FIG. 13.

As is shown in FIG. 13, the first 64*a* and second 64*b* upper sections are connected to first 66*a* and second 66*b* upper adjustment sections, respectively, by conventional ball joint assemblies 174*a,b*, shown in enlarged detail in FIG. 14B. Third 68*a* and fourth 68*b* upper adjustment sections are telescopically inserted into first 66*a* and second 66*b* upper adjustment sections, respectively, and are held in place by locking rings 70, as shown in enlarged detail in FIG. 14C.

The third 68*a* and fourth 68*b* upper adjustment sections terminate in upper connectors 72*a,b*, respectively. In this embodiment the at least one upper connector 72 is the tongue portion of a conventional buckle-and-tongue type releasable connector system similar to, for example but not limited to, the buckle-and-tongue releasable connector system used in an automotive seat belt. The buckle portion (not shown) of the buckle-and-tongue type releasable connector system can be attached to at least one shoulder strap 92 to enable the upper region 6 of the frame 2 to be releasably connected to the shoulder strap 92.

As shown in FIG. 14B, a ball joint assembly 174 comprises a ball head 176, a socket 178, and a set screw 180, which allow the ball head 176 to be positioned and secured at a desired angle with respect to the at least one upper section 64, as shown by arrows 74 and 182 in FIG. 13. Alternatively, when the set screw 180 in the ball joint assembly 174 is left loose, the ball joint assembly 174 is freely foldable in the directions shown by arrows 74 and 182 in FIG. 13 and can thereby function as an accommodation mechanism 78 to enable the upper region 6 to move in relation to the lower region 4 to dynamically accommodate changes in the position of the user's torso.

Figure 14D:
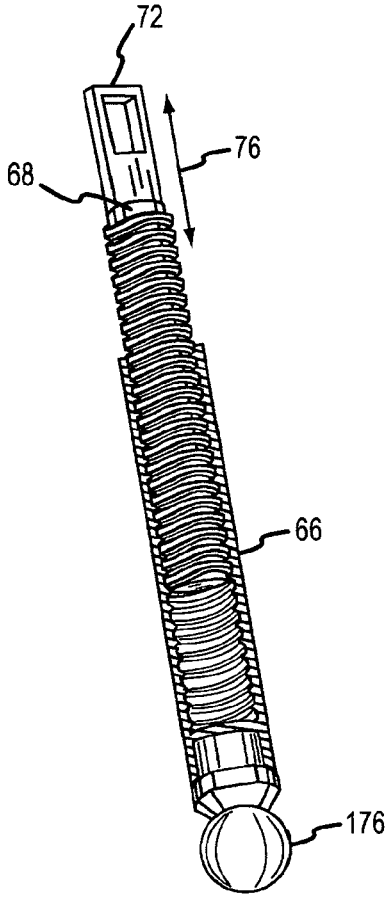
FIG. 14D shows an enlarged view of an alternative embodiment of the length adjustment mechanism in the upper region of the frame of FIG. 13.
Figure 14E:
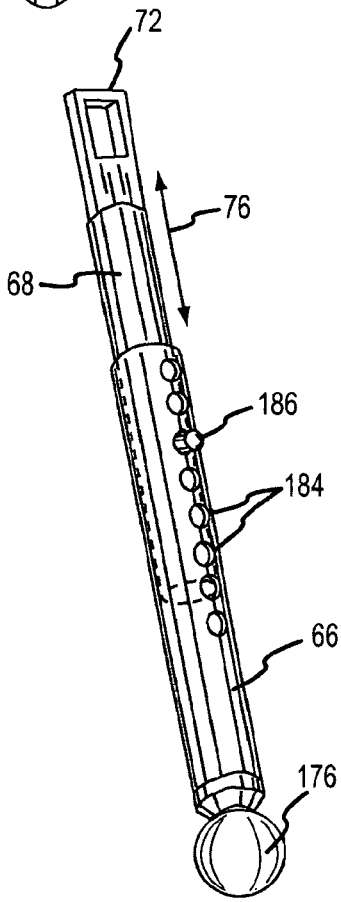
FIG. 14E shows an enlarged view of another alternative embodiment of the length adjustment mechanism in the upper region of the frame of FIG. 13.

FIGS. 14D and 14E show alternative mechanisms to achieve length adjustment in the upper region 4 of the frame 2. Referring initially to FIG. 14D, the first upper adjustment section 66*a* is internally threaded, and the third upper adjustment section 68*a* is externally threaded, allowing the third upper adjustment section 68*a* to be screwed into the first upper adjustment section 66*a* to a desired depth, thereby shortening or lengthening the distance from the ball head 176 to the upper connector 72. Referring then to FIG. 14E, the third upper adjustment section 68*a* is telescopically inserted into the first upper adjustment section 66*a*. The first upper adjustment section 66*a* has a plurality of positioning pin holes 184. A spring-loaded positioning pin 186 protrudes through a positioning pin hole 184 (obscured) in the third upper adjustment section 68*a* and through a selected positioning pin hole 184 in the first upper adjustment section 66*a*. When the positioning pin 186 is depressed, the third upper adjustment section 68*a* can be moved into or out of the first upper adjustment section 66*a*, thereby shortening or lengthening the distance from the ball head 176 to the upper connector 72. The third upper adjustment section 68*a* is fixed in a desired position by allowing the positioning pin 186 to protrude through a desired positioning pin hole 184 in the upper adjustment section 66. It can be seen that each of the mechanisms set forth in FIGS. 14C, 14D, and 14E, working in conjunction with the ball joint assembly 174, allows for the upper region 6 of the frame 2 to be positioned at a desired configuration and distance from the upper torso of the user 6, to fit the frame 2 to users of different sizes and shapes.

Returning then to FIG. 13, at the lower end of the lower section 8 there is a horizontal dovetail slot 188 running from the left edge to the right edge of the lower section 8. Inserted into the left and right openings of the horizontal dovetail slot 188 are a first 20*a* and a second 20*b* horizontal adjustment section. The horizontal adjustment sections 20*a,b* and the horizontal dovetail slot 188 are complementary in cross-section and easily slide together in the same fashion as the dovetailed upper sections 64*a,b* slide in the vertical slots 172 of the lower section 8. Thus, the lower section 8 extends between the horizontal adjustment sections 20*a,b*. The distal end of each adjustment section 20 has at least one lower connector 22. In this embodiment, the at least one lower connector 22 is in the shape of a serrated and bored disc to permit the pivotal attachment of a wide variety of prior art or future connector components or systems for connecting the frame 2 to at least one hip belt 94.

The horizontal adjustment sections 20*a,b* are each positioned to a desired depth within the horizontal dovetail slot 188 and are secured with set screws 190. This inter-sliding adjustment mechanism enables the lower region 4 of the frame 2 to be adjusted so that the distance between the first lower connector 22*a* and second lower connector 22*b* can be increased or decreased to fit users of different lower torso widths.

In the embodiment of FIG. 13, the at least one accommodation mechanism 78 comprises at least one inter-sliding assembly, specifically the sliding dovetail joints formed by the insertion of the first 64*a* and second 64*b* upper sections in the lower section 8. The use of freely sliding dovetail joints allows the first 64*a* and second 64*b* upper sections to move freely up and down vertically within the lower section 8 in the direction shown by arrow 80, thus enabling the distance between the at least one lower connector 22 and the at least one upper connector 72 to change automatically in response to changes in the position of the user's torso.

While FIGS. 13 and 14A show a particular shape of sliding dovetail joint having a classic "dovetail" cross-section, that is not a necessary or limiting factor in this specification or the appended claims. A sliding dovetail joint could have a "T" shaped cross section, or a "Y" shaped cross-section, or a wedge-shaped cross-section, or any other cross-section that allows the joined frame sections to slide freely with respect to each other in the vertical dimension but prevents them from becoming displaced from each other in the horizontal dimension. All such sliding dovetail joint shapes and prior art and future equivalents thereof are intended to be within the scope of this specification and the appended claims.

The accommodation mechanism 78 of FIG. 13 also comprises at least one foldable assembly, specifically the ball joints 174*a,b* that enable the first 66*a*, second 66*b*, third 68*a*, and fourth 68*b* upper adjustment sections to fold and unfold in the directions shown by arrows 74 and 182, thereby enabling the distance between the at least one lower connector 22 and the at least one upper connector 72 to change automatically in response to changes in the position of the user's torso.

In the embodiment of FIG. 13, the folding ball joints 174*a,b* and the inter-sliding dovetail joints 164,172 can operate independently, in combination, sequentially, or simultaneously to function as an accommodation mechanism 78. This particular configuration of accommodation mechanism 78 is not, however, a necessary or limiting factor of this specification or the appended claims. Any type of mechanism that enables the distance between the at least one lower connector 22 and the at least one upper connector 72 to change automatically in response to changes in the position of the user's torso during use of the system is intended to be within the teaching of this specification and the scope of the appended claims.

Figure 15:
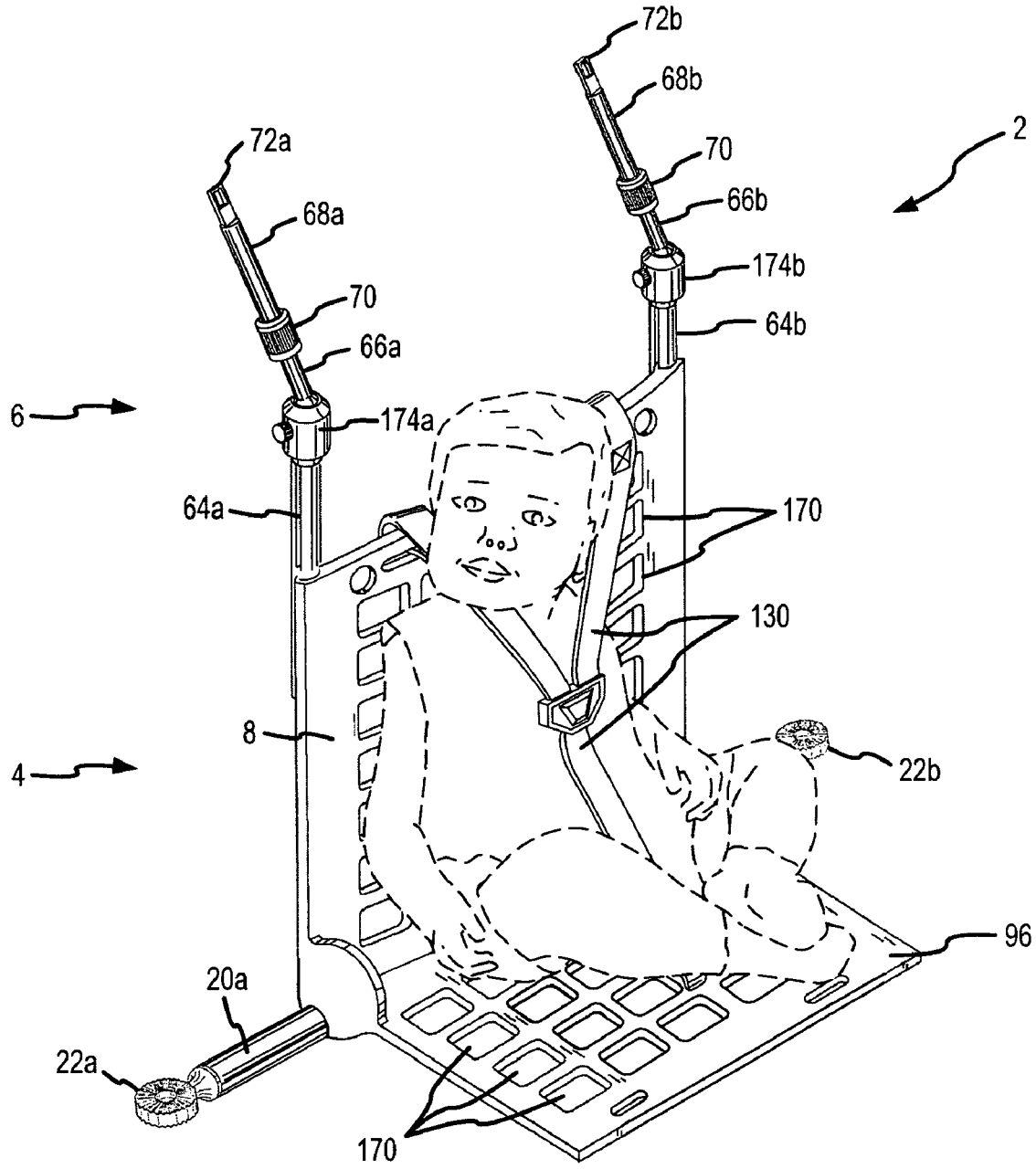
FIG. 15 is a perspective view of the frontpack frame system of FIG. 13, illustrating an article securing mechanism that secures a bulky item, such as a child (shown in phantom).

The embodiment of FIG. 13 can hold and carry a wide variety of different shapes, sizes, and weights of articles. By way of example and not limitation, FIG. 15 shows the frame 2 of FIG. 13 with straps 130 that attach to a plurality of openings 170 in the lower section 8 and the platform 96. The straps 130 are useful for holding and securing a bulky article, for example but not limited to, a child (shown in phantom). The strapping system 130 of FIG. 15 is not, however, a necessary or limiting factor in this specification or the appended claims. A frontpack system can use any type of prior art or future article securing mechanism 102, for example but not limited to, a mechanism selected from the group consisting of straps, buckles, and holders, or some combination of these, or none at all, and still be within the teaching of this specification and the scope of the appended claims.

Similarly, the several adjustment mechanisms in the lower region 4 and the upper region 6 of the frame 2 shown in FIGS. 13-15 can be useful in adjusting the frame 2 to fit users with torsos of different sizes and shapes, but these adjustment mechanisms are not a necessary or limiting factor of this specification or the appended claims. A frontpack system could be constructed with less than all of these adjustment mechanisms, or with completely non-adjustable lower region 4 and upper region 6, and still be within the teaching of this specification and within the scope of the appended claims.

In the embodiment of FIGS. 13-15, releasable connectivity to a harness is achieved through the use of tongue-type upper connectors 72 that are compatible with the buckle portion of a prior art or future tongue-and-buckle connector system and serrated disc lower connectors 22 to which a wide variety of prior art or future releasable connector elements may be attached. This configuration of connectors is not a necessary or limiting factor of this specification or the appended claims. The use of any type of a prior art or future releasable connector system to releasably connect the frontpack frame 2 to a harness worn by a user is within the teaching of this specification and the scope of the appended claims. Moreover, a frontpack frame 2 can be non-releasably attached to a harness worn by a user and still be within the teaching of this specification and the scope of the appended claims.

Figure 16:
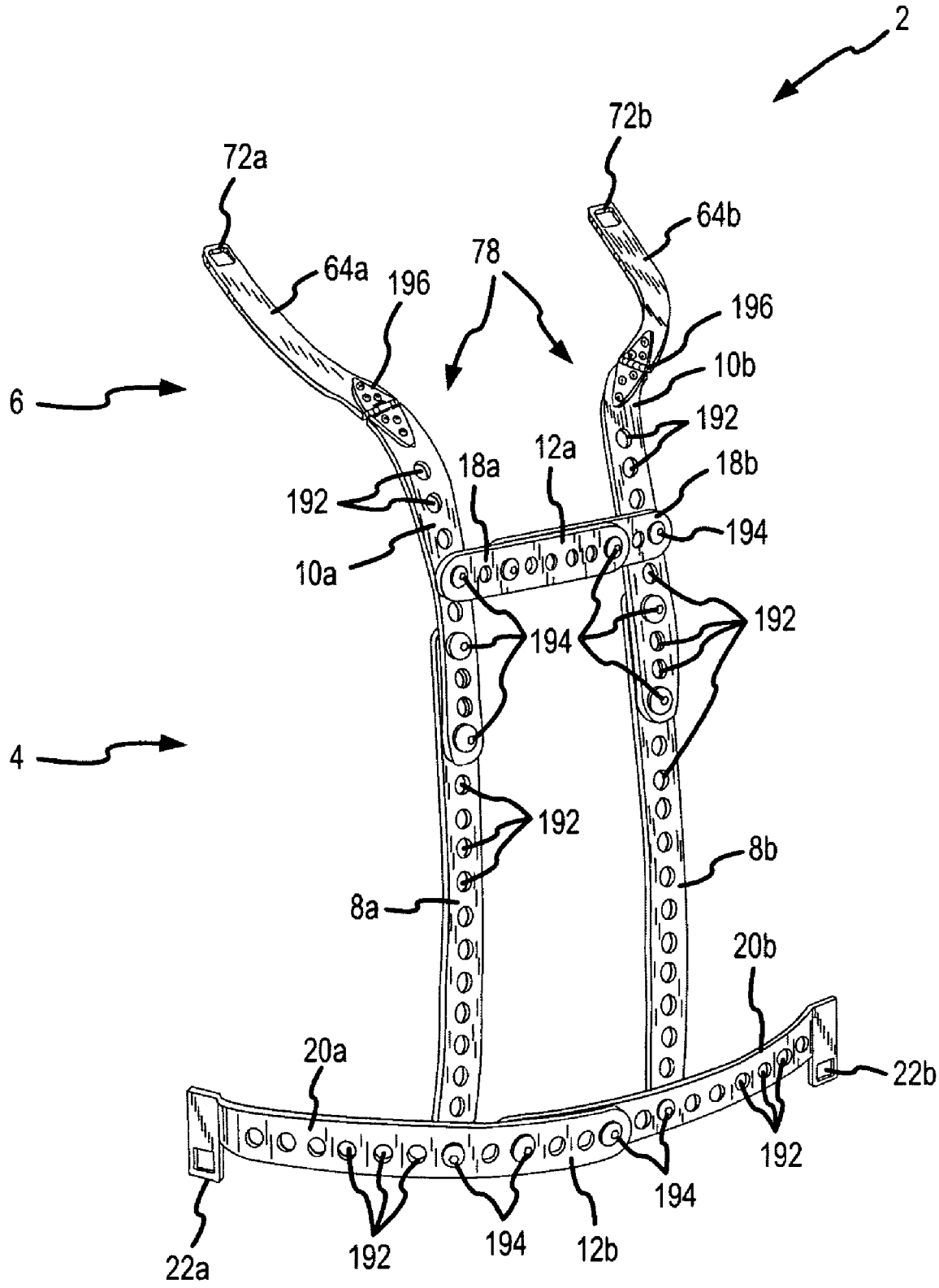
FIG. 16 is a perspective view of an embodiment of a frontpack system having an accommodation mechanism comprising hinges.

Now turning to FIG. 16, another embodiment of the frame 2 is shown. In this embodiment, the lower region 4 has at least one lower section 8 that is sufficiently rigid to support the weight of at least one article secured upon the lower region 4 and to transfer the weight of the at least one article downward. In this embodiment, the lower region 4 comprises a first lower section 8*a*, a second lower section 8*b*, a third lower section 10*a*, and a fourth lower section 10*b*, all of which are stay-shaped and all of which have a plurality of equally spaced holes 192 along their lengths. The first 8*a* and second 8*b* lower sections are attached to the third 10*a* and fourth 10*b* lower sections, respectively, by a plurality of nuts (not shown) and bolts 194 that penetrate aligned holes 192. The vertical length of the lower region 4 is adjustable by raising or lowering the third 10*a* and fourth 10*b* lower sections so as to align their holes 192 with different holes 192 in the first 8*a* and second 8*b* lower sections, respectively, and then securing a plurality of nuts (not shown) and bolts 194 through the newly aligned holes 192.

An upper horizontal section 12*a* is similarly formed of an overlapping first horizontal section 18*a* and second horizontal section 18*b*, each having a plurality of equally spaced holes 192. A lower horizontal section 12*b* is similarly formed of an overlapping first 20*a* and second 20*b* horizontal adjustment sections. The upper 12*a* and lower 12*b* horizontal sections are connected to the first 8*a*, second 8*b*, third 10*a*, and fourth 10*b* lower sections by a plurality of nuts (not shown) and bolts 194 through aligned holes 192. The upper 12*a* and lower 12*b* horizontal sections are adjustable in horizontal length by changing the alignment of holes 192 and bolts 194 as previously described.

The lower region 4 has at least one lower connector 22 to connect the lower region to at least one hip belt 94. In the embodiment of FIG. 16, first 22*a* and second 22*b* lower connectors extend from the first 20*a* and second 20*b* horizontal adjustment sections, respectively. The at least one lower connector 22 is a tongue-type connector that can releasably connect to the buckle portion of a conventional buckle-and-tongue type releasable connector system similar to, for example but not limited to, the buckle-and-tongue releasable connector system used in an automotive seat belt. The buckle portion (not shown) of the buckle-and-tongue type releasable connector system can be attached to at least one shoulder strap to enable the upper region 6 of the frame 2 to be releasably connected to the shoulder strap.

The first 8*a*, second 8*b*, third 10*a*, and fourth 10*b* lower sections and the upper 12*a* and lower 12*b* horizontal sections form a lower region that is sufficiently rigid to support the weight of at least one article secured upon the lower region and to transfer the weight of the at least one article downward. The lower connectors 22*a,b* can transmit the weight of the frame 2 and any front-carried articles to the frontal area of the hip belt worn by the user.

The upper region 6 of the embodiment of FIG. 16 comprises a first upper section 64*a* and a second upper section 64*b*, which are sufficiently rigid to position and restrict the movement of the upper region 6 in relation to at least one shoulder strap 92 (not shown). At least one upper connector 72 extends from the upper sections 64*a*, 64*b*. In this embodiment the at least one upper connector 72 is a tongue-type connector that can releasably connect to the buckle portion of a conventional buckle-and-tongue type releasable connector system similar to, for example but not limited to, the buckle-and-tongue releasable connector system used in an automotive seat belt. The buckle portion (not shown) of the buckle-and-tongue type releasable connector system can be attached to at least one hip belt 94 (not shown) to enable the upper region 6 of the frame 2 to be releasably connected to the hip belt 94.

In the embodiment of FIG. 16, the frame 2 has at least one accommodation mechanism 78 that enables the upper region 6 to move in relation to the lower region 4. The accommodation mechanism 78 comprises a foldable mechanism provided by at least one hinge 196 connecting the third lower section 10*a* to the first upper section 64*a* and the fourth lower section 10*b* to the second upper section 64*b*. The at least one hinge 196 can fold and unfold, thereby enabling the distance between the at least one upper connector 72 and the at least one lower connector 22 to change automatically in response to changes in the position of the user's torso during front-carry activities. The use of a hinged type of folding accommodation mechanism 78 is not, however, a necessary or limiting factor of this specification or the appended claims. Any type of mechanism that enables the distance between the at least one lower connector 22 and the at least one upper connector 72 to change automatically in response to changes in the position of the user's torso during use of the system is intended to be within the teaching of this specification and the scope of the appended claims.

As shown in FIG. 16, the several stay-shaped sections 8*a*, 8*b*, 10*a*, 10*b*, 64*a*, 64*b*, 12*a*, 12*b* of this embodiment of the frame 2 are shaped and dimensioned to position and maintain the frame 2 at a spaced-apart distance from the front torso of the user. The sections 8*a*, 8*b*, 10*a*, 10*b*, 64*a*, 64*b*, 12*a*, 12*b* are easily disassembled and reassembled to adjust the height and width of frame 2 to fit users of differing sizes and shapes. When made of a suitable malleable material, such as, for example, aluminum alloy, the sections 8*a*, 8*b*, 10*a*, 10*b*, 12*a*, 12*b*, 64*a*, 64*b* can be semi-permanently bent and shaped as a further means of adjusting the frame 2 of FIG. 16 to fit users of differing sizes and shapes. Here, as with other embodiments, this adjustability is not a necessary or limiting factor of this specification or the appended claims. A frontpack system could be constructed with less than all of these adjustment features, or with completely non-adjustable lower region 4 and upper region 6, and still be within the teaching of this specification and within the scope of the appended claims.

While FIG. 16 shows a frame 2 having a certain configuration comprising stay-shaped sections and describes the frame as being made of semi-malleable material, these are not limiting factors in this specification or the appended claims. A frame could be constructed with a different configuration of sections having different shapes, and could be made of malleable or non-malleable material, or a combination of materials, and still be within the teaching of this specification and the scope of the appended claims.

The frame 2 of FIG. 16 can releasably connect to any backpack or other suitable harness having compatible buckle-and-tongue type shoulder strap connectors and hip belt connectors, but this is not a necessary or limiting factor in this specification or the appended claims. Here, as with other embodiments, the use of any type of a prior art or future releasable connector system or non-releasable connector system to connect the frame 2 to a harness worn by a user is within the teaching of this specification and the scope of the appended claims.

The frontpack system of FIG. 16 can carry a wide range of shapes, sizes, and weights of articles by securing such articles to the lower region 4 of the frame 2 using any suitable prior art or future article securing mechanism 102 such as, for example but not limited to, a mechanism selected from the group consisting of straps, buckles, and holders, but this is not a limiting factor. A frontpack system could be constructed with no article securing mechanism 102, and still be within the teaching of this specification and the appended claims.

FIG. 17 shows a mechanically different but functionally similar embodiment of a frontpack system, in which the frame 2 is flexible and is releasably connected to a harness 90. In this embodiment, a first lower section 8*a*, a second lower section 8*b*, and a first upper section 64*a* are formed of a unitary piece of material that is resiliently flexible and that is normally bowed. Similarly, a second lower section 8*b*, a fourth lower section 10*b*, and a second upper section 64*b* are formed of a unitary piece of material that is resiliently flexible and that is normally bowed. A lower horizontal section 12*b* is connected to the first 8*a* and second 8*b* lower sections by bolted clamps 25. Similarly, an upper horizontal section 12*a* is connected to the second 10*a* and fourth 10*b* lower sections by bolted clamps 14.

The lower region 4 has at least one lower connector 22 to connect the lower region 4 to at least one hip belt 94. In this embodiment, side-squeeze buckle type lower connectors 22*a*, 22*b* are attached to the lower ends of the first 8*a* and second 8*b* lower sections, respectively, for releasably connecting the lower region 4 to the hip belt connectors 118*a,b* of the removable harness 90. The upper region 6 has at least one upper connector 72 to connect the upper region 6 to at least one shoulder strap 92. In this embodiment, side-squeeze buckle type upper connectors 72*a,b* are attached to the first 64*a* and second 64*b* upper sections, respectively, for releasably connecting the upper region 6 to the shoulder strap connectors 116*a,b* of the removable harness 90.

A harness 90 is designed and constructed identically to the harness 90 of FIG. 12, except as follows. Whereas the harness 90 of FIG. 12 was connected to the frame 2 by rivets and had no mechanism for releasably connecting the frame 2 to the harness 90, the harness 90 of FIG. 17 includes side-squeeze buckle type shoulder strap connectors 116*a,b* attached to the shoulder straps 92 and side-squeeze buckle type hip belt connectors 118*a,b* attached to the hip belt 94. The shoulder strap connectors 116*a,b* and the hip belt connectors 118*a,b* quickly connect to and disconnect from the upper 72 and lower 22 connectors, respectively, of the frame 2. This allows the user to quickly don and doff the frame 2 without removing the harness 90 from the body. Alternatively, the user can don or doff the harness 90 without removing the frame 2 from the harness 90, in the same manner as a user of the embodiment shown in FIG. 12 would do.

The frame 2 has at least one accommodation mechanism 78 that enables the upper region 6 to move in relation to the lower region 4. As noted, the first lower section 8*a*, second lower section 8*b*, third lower section 10*a*, fourth lower section 10*b*, first upper section 64*a*, and second upper section 64*b* are all formed of resiliently flexible material. When the frame 2 is connected to the harness 90 worn by a user, these resiliently flexible frame sections 8*a*, 8*b*, 10*a*, 10*b*, 64*a*, and 64*b* will bend in response to changes in the position of the user's torso. These resiliently flexible frame sections 8*a*, 8*b*, 10*a*, 10*b*, 64*a*, and 64*b* thus function as the at least one accommodation mechanism 78 to enable the distance between the at least one lower connector 22 and the at least one upper connector to change automatically in response to changes in the position of the user's torso during use of the system. Because these frame sections 8*a*, 8*b*, 10*a*, 10*b*, 64*a*, and 64*b* are resiliently flexible, they automatically return to their normally bowed positions when the user's torso returns to a normal upright position.

While the frame 2 of FIG. 17 is sufficiently flexible to function as an accommodation mechanism 78, the frame 2 is also sufficiently rigid to perform its essential functions. The lower region 4 is sufficiently rigid to support the weight of at least one article secured upon the lower region 4 and to transfer the weight of the at least one article downward. The upper region 6 is sufficiently rigid to position and restrict the movement of the upper region 6 in relation to the at least one shoulder strap. Achieving a satisfactory balance of flexibility and rigidity in the frame 2 is a matter of materials engineering that will be readily apparent to one skilled in the art.

While the embodiment of FIG. 17 is shown and described as comprising only flexible frame sections, this is not a necessary or limiting factor in this specification or the appended claims. A frontpack frame 2 could be constructed with a combination of flexible sections and rigid sections, or with sections having varying degrees of flexibility, and still be within the teaching of this specification and the scope of the appended claims.

Similarly, while the frame 2 of FIG. 17 is shown and described as having a first lower section 8*a*, second lower section 8*b*, and first upper section 64*a* formed of a unitary piece of material and a second lower section 8*b*, fourth lower section 10*b*, and second upper section 64*b* formed of a unitary piece of material, this is not a necessary or limiting factor in this specification or the appended claims. A frontpack frame 2 could be constructed with more or fewer unitary pieces of material joined together, or could be constructed out of a single unitary piece of material, and still be within the teaching of this specification and the scope of the appended claims.

Furthermore, while the frame 2 of FIG. 17 is shown as being formed of sections that are generally round and elongated, this is not a necessary or limiting factor in this specification or the appended claims. A frontpack frame 2 could be constructed of planar sections, or elongated sections with non-round cross-sections, or myriad other shapes or combinations of shapes, and still be within the teaching of this specification and the scope of the appended claims.

The flexible accommodation mechanism 78 of FIG. 17 is also not a necessary or limiting factor of this specification or the appended claims. Any type of accommodation mechanism 78 that enables the distance between the at least one lower connector 22 and the at least one upper connector 72 to change automatically in response to changes in the position of the user's torso during use of the system is intended to be within the teaching of this specification and the scope of the appended claims.

In the embodiment of FIG. 17, releasable connectivity to a harness 90 is achieved through the use of side-squeeze buckle type lower 22 and upper 72 connectors that are compatible with the mating portion of a prior art or future side-squeeze buckle type of releasable connector system. However, this is not a necessary or limiting factor of this specification or the appended claims. The use of any type of a prior art or future releasable connector system to releasably connect the frontpack frame 2 to a harness worn by a user is within the teaching of this specification and the scope of the appended claims. Moreover, a frontpack frame 2 can be non-releasably attached to a harness worn by a user and still be within the teaching of this specification and the scope of the appended claims.

The harness 90 of FIG. 12 is shown as being composed of over a dozen segments, four buckle systems, and three adjustment buckles, but this is not a necessary or limiting factor in this specification or the appended claims. The harness 90 could be composed of less or more segments, buckle systems, and buckles and still be within the teaching of this specification and the scope of the appended claims. While the shoulder straps 92 and hip belt 94 are shown as being connected to one another by various intermediate straps, the harness 90 could be constructed of shoulder straps 92 and a hip belt 94 that are isolated and unconnected. While certain parts of the harness 90, specifically the shoulder straps 92 and hip pads 162*a,b*, are shown to be made of more robust and padded material, that is also not a necessary feature or limiting factor in the harness 90. While the buckle systems of integrated harness 90 are shown as side-squeeze type releasable buckles, any prior at or future equivalent buckle systems or releasable connector system may be substituted for these buckle systems without affecting the basic operations of the harness 90.

The frontpack system of FIG. 17 can carry a wide range of shapes, sizes, and weights of articles by securing such articles to the lower region 4 of the frame 2 using any suitable prior art or future article securing mechanism 102, for example but not limited to, a mechanism selected from the group consisting of straps, buckles, and holders (not shown).

Figure 18:
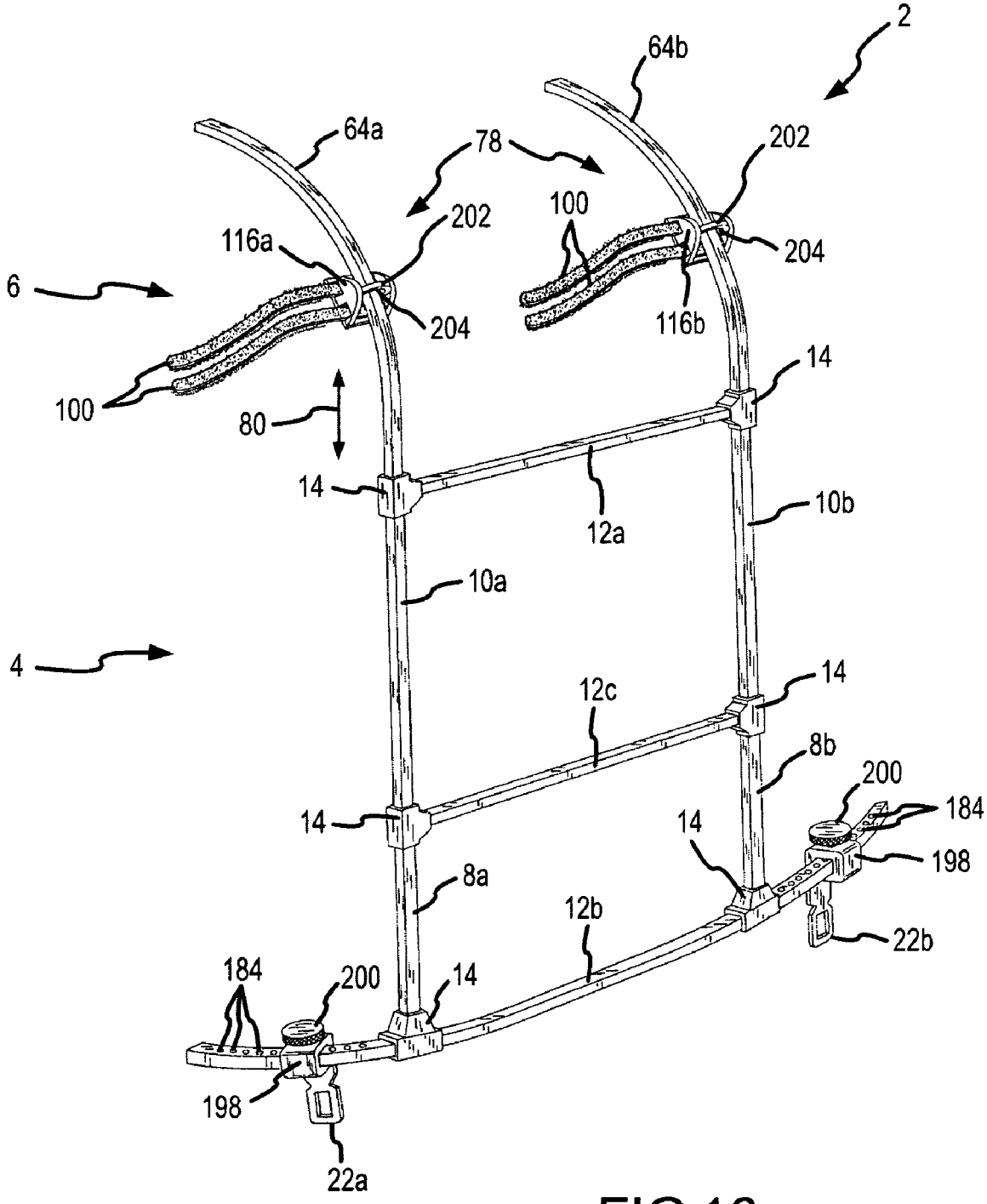
FIG. 18 is a perspective view of a frontpack system comprising a frame and an accommodation mechanism comprising shoulder strap connectors having shapes to capture and restrict the movement of the upper region of the frame in the horizontal dimensions, while leaving the upper region free to move vertically in relation to the shoulder strap connectors.

Now turning to FIG. 18, another embodiment is illustrated of a frame 2 having a lower region 4 and an upper region 6. In this embodiment, a first lower section 8*a*, a second lower section 8*b*, and a first upper section 64*a* are formed of a unitary piece of material that is substantially rigid but semi-malleable. Similarly, a second lower section 8*b*, a fourth lower section 10*b*, and a second upper section 64*b* are formed of a unitary piece of material that is substantially rigid but semi-malleable. The first 64*a* and second 64*b* upper sections are each semi-permanently bent to a curvature that approximates the curvature of the upper torso of a user. A lower horizontal section 12*b* extends between and is connected to the first 8*a* and second 8*b* lower sections by collars 14. Similarly, upper horizontal sections 12*a*, 12*c* extend between and are connected to the second 10*a* and fourth 10*b* lower sections by collars 14.

The first lower section 8*a*, second lower section 8*b*, third lower section 10*a*, fourth lower section 10*b*, and horizontal sections 12*a*, 12*b*, and 12*c* form a lower region 4 of the frame 2 that is sufficiently rigid to support the weight of at least one article secured upon the lower region 4 and to transfer the weight of the at least one article downward. The upper region 6 is sufficiently rigid to position and restrict the movement of the upper region in relation to the at least one shoulder strap 92.

The lower horizontal section 12*b* extends to the left and right beyond the collars 14 that connect with the first 8*a* and second 8*b* lower sections. The left and right extremities of the lower horizontal section 12*b* carry a plurality of positioning pin holes 184 along their upper surfaces. The lower region 4 has at least one lower connector 22 to connect the lower region 4 to at least one hip belt 94. In this embodiment, a first lower connector 22*a* and second lower connector 22*b* are attached to the distal ends of the lower horizontal section 12*b*. The lower connector 22 comprises a central casing 198 and a threaded positioning pin 200 with knurled nut head. The central casing 198 slides upon the lower horizontal section 12*b* to a desired position. The threaded positioning pin 200 extends through a threaded hole (not shown) in the central casing 198 to engage with a selected positioning pin hole 184, in order to fix the lower connector 22 in a desired position. This inter-sliding adjustment mechanism enables the lower region 4 of the frame 2 to be adjusted so that the distance between the first lower connector 22*a* and second lower connector 22*b* can be increased or decreased to fit users of different lower torso widths.

The at least one lower connector 22 is the tongue portion of a conventional buckle-and-tongue type releasable connector system similar to, for example but not limited to, the buckle-and-tongue releasable connector system used in an automotive seat belt. The buckle portion (not shown) of the buckle-and-tongue type releasable connector system can be attached to at least one hip belt to enable the lower region 4 of the frame 2 to be releasably connected to the hip belt.

Shoulder strap connectors 116*a,b* have hook-and-loop straps 100, each having a hook surface on one side and a loop surface on the other side, such that the front side of each strap 100 will releasably stick to the back side. The second, loose end of each hook-and-loop strap 100 is wrapped snugly around at least one shoulder strap in the manner previously illustrated in FIGS. 8A and 11A.

Each shoulder strap connector 116*a,b* has at least one ring 202, which allows the shoulder strap connector 116*a,b* to be slidably installed over the upper end of the first 64*a* or second 64*b* upper section. Each ring 202 has a circular, fully enclosed opening 204 through which an upper end of an upper section 64*a,b* is inserted. Each ring 202 thereby constrains the upper region 6 of the frame 2 in close horizontal proximity to a shoulder strap 92 (not shown) worn by the user, but allows the upper section 64*a,b* to move freely in the vertical dimension in relation to the shoulder strap 92 in the directions shown by arrows 80. This serves as an accommodation mechanism 78 to enable the distance between the lower connectors 22 and the shoulder strap connectors 116*a,b* to change automatically in response to changes in the position of the user's torso during use of the system.

It will be noted that in the embodiment of FIG. 18, the accommodation mechanism 78 does not enable the upper region 6 to move in relation to the lower region 4. Rather, in this embodiment the accommodation mechanism 78 enables the upper region 6 to move or change position in relation to the shoulder strap connectors 116*a,b*. It will be readily apparent to one skilled in the art that many shapes other than circular rings 202 can be incorporated into the shoulder strap connectors 116*a,b* to constrain the upper region 6 in the horizontal dimension while leaving the upper region 6 free to move in the vertical dimension. For example, oval, polygonal, or other non-circular shaped openings in the shoulder strap connectors 116*a,b* can constrain the upper region 6 against horizontal movement but not against vertical movement. Rings and other cross-sectional shapes can be extended to form tubes or sleeves into which the upper region 6 can be telescopically inserted to constrain the upper region 6 against horizontal movement but not vertical movement. Sliding dovetail joints, like those employed as an accommodation mechanism 78 in the embodiment shown in FIGS. 13 and 14A, can also be employed because the mating cross-sectional shapes enable the shoulder strap connectors 116*a,b* to constrain the upper region 6 in the horizontal dimension while leaving it free to move in the vertical dimension. The shoulder strap connector 116 can have a "male" dovetail shape that slidably mates with a "female" dovetail shape on the upper region 6, or the shoulder strap connector 116 can have a "female" dovetail shape that slidably mates with a "male" dovetail shape on the upper region 6. The cross-section of the sliding dovetail joint can be a classic "dovetail" shape, or "T" shaped, or "Y" shaped, or wedge-shaped, or any prior art or equivalent shape for a sliding dovetail joint. All of these shapes of the shoulder strap connector 116, and prior art and future equivalent shapes that enable the shoulder strap connector 116 to capture the upper region 6 and restrict its movement in the horizontal dimension while leaving it free to move in the vertical dimension, are meant to be within the teaching of this specification and the scope of the appended claims.

The inter-sliding adjustment mechanism in the lower region 4 of the frame 2 of FIG. 18 is not a necessary or limiting factor of this specification or the appended claims. A frontpack system could be constructed without this adjustment mechanism and still be within the teaching of this specification and within the scope of the appended claims.

While the frame 2 of FIG. 18 is shown as having a particular configuration comprising certain unitary pieces of material and is described as being made of semi-malleable material, these are not necessary or limiting factors in this specification or the appended claims. A frame 2 could be made in a different configuration with more or fewer unitary pieces, and could be made of malleable or non-malleable material, or a combination of materials, and still be within the teaching of this specification and the scope of the appended claims.

In the embodiment of FIG. 18, releasable connectivity to a harness is achieved through the use of tongue-type lower connectors 22*a,b* and hook-and-loop strap shoulder connectors 116*a,b* that function as explained for other embodiments above. The use of these types of releasable connector systems or attachment systems is not a necessary or limiting factor of this specification or the appended claims. The use of any type of a prior art or future releasable connector system to connect the frontpack frame 2 and shoulder strap connectors 116 to a harness worn by a user is within the teaching of this specification and the scope of the appended claims. Moreover, the frame 2 and shoulder strap connectors 116 of FIG. 18 could be non-releasably connected or attached to a harness worn by a user and still be within the teaching of this specification and the scope of the appended claims.

The frontpack system of FIG. 18 can carry a wide range of shapes, sizes, and weights of articles by securing such articles to the lower region 4 of the frame 2 using any suitable prior art or future article securing mechanism 102, for example but not limited to, a mechanism selected from the group consisting of straps, buckles, and holders (not shown).

It will also be readily apparent to one skilled in the art that with minor modifications, the various elements of the foregoing embodiments can be combined in myriad different permutations. By way of example and not limitation: The telescopic tube-type frame 2 of FIG. 1 can be fitted with side-squeeze type upper 72 and lower 22 connectors such as are shown in FIG. 17 for releasable connection to a removable harness 90 of the type disclosed in FIG. 17. The stay-type frame 2 of FIG. 16 can be fitted with semi-spherical upper 72 and lower 22 frame connectors such as are shown in FIGS. 1 and 7 for releasable connection to ball-and-socket type shoulder strap 116 and hip belt 118 connectors such as are shown in FIGS. 8A and 8B. A foldable hinge-type accommodation mechanism 78 of the type shown in FIG. 16, or a telescopic tube-type accommodation mechanism 78 of the type shown in FIG. 9, can be utilized with a cast, molded, milled, or stamped lower region 4 of frame 2 of the type shown in FIG. 13. An inter-sliding dovetail joint accommodation mechanism 78 such as is shown in FIG. 13 can function as an accommodation mechanism 78 in the shoulder strap connectors 116 of the embodiment of FIG. 18. Any and all of the frame 2 embodiments taught by the above specification can be non-releasably connected to a harness 90 in the fashion shown in FIG. 12, or can be releasably connected to a harness 90 as shown in FIG. 17, or can be releasably connected to a harness such as a backpack using removable shoulder strap 116 and hip belt 118 connectors such as are shown in FIGS. 8A, 8B, 11A, and 11B.

Moreover, it will be equally apparent to one skilled in the art that each of the embodiments of the frame 2 can be configured to fit in multiple ways upon the front torso of the user. By way of example and not limitation: Each embodiment of the frame 2 can be configured for deployment entirely on the left side or the right side of the front torso, or entirely at the center of the front torso, as is taught above in the discussion of the embodiment shown in FIGS. 6A and 6B. Each embodiment of the frame 2 can be configured so that one or more sections 8*a*, 64*a* and accommodation mechanisms 78 are located at approximately the center of the user's front torso, but other frame sections 66, 18 and connectors 22, 72 are located symmetrically to the left and to the right of center, as is taught in the discussion of the embodiment illustrated in FIG. 7. Each embodiment of the frame 2 can be configured so that frame sections 8, 64, accommodation mechanisms 78, and connectors 22, 72 are located symmetrically to the left and to the right of center, and are connected by at least one horizontal section 12, as is taught in the specification discussing the embodiments shown in FIGS. 1, 5A, 9, 12, 16, 17, and 18.

The various permutations and configurations of the frame 2 taught by the above specification are virtually endless and will be obvious to one skilled in the art, and therefore no useful purpose would be served by attempting to itemize all of the permutations and configurations here. Each and every permutation and configuration of the foregoing design elements and components that achieves the essential functions of the frontpack system is fully intended to be within the scope of this specification and the appended claims.

The foregoing exemplary descriptions and the illustrative embodiments have been explained in the drawings and described in detail, with varying modifications and alternative embodiments being taught. While the frame has been so shown, described, and illustrated, it should be understood by those skilled in the art that equivalent changes in form and detail may be made therein without departing from the true spirit and scope of the frame as set forth in the following claims. Moreover, the frame as disclosed herein may be suitably practiced in the absence of the specific elements which are disclosed herein.

We claim:

1. A system for carrying articles at the front torso of a human user who is wearing a harness having at least one shoulder strap and at least one hip belt, with the at least one shoulder strap operably tightened about the user and having at least one segment positioned upon a front pectoral region of the user, the system comprising:

a frame having an upper region and a lower region;

the lower region having at least one lower section that is sufficiently rigid to support the weight of at least one article secured upon the lower region and to transfer the weight of the at least one article downward;

the lower region having at least one lower connector to connect the lower region to the at least one hip belt;

the upper region having at least one upper section that is sufficiently rigid to position and restrict the movement of the upper region in relation to the at least one shoulder strap;

the upper region having at least one upper connector to connect the upper region to the at least one shoulder strap;

the at least one lower connector and the at least one upper connector located on a same side of a center sagittal plane of the user;

the frame having at least one accommodation mechanism that enables the upper region to move in relation to the lower region so that the distance between the at least one lower connector and the at least one upper connector can change automatically in response to changes in the position of the user's torso during use of the system; and at least one article securing mechanism directly attached to the frame.

2. The system of claim 1 wherein the at least one accommodation mechanism comprises at least one inter-sliding assembly in which a first frame element slides substantially parallel to a longitudinal dimension of a second frame element.

3. The system of claim 2 wherein the at least one inter-sliding assembly is selected from the group consisting of telescopic assemblies and sliding dovetail assemblies.

4. The system of claim 1 wherein the at least one accommodation mechanism comprises at least one foldable assembly.

5. The system of claim 4 wherein the at least one foldable assembly is selected from the group consisting of hinges and ball joints.

6. The system of claim 1 wherein the at least one lower connector connects to the at least one hip belt using at least one quick-releasable connector system.

7. The system of claim 6 wherein the at least one quick-releasable connector system is selected from the group consisting of hook-and-loop straps, ball-and-socket connectors, side-squeeze buckle connectors, and buckle-and-tongue connectors.

8. The system of claim 1 wherein the at least one upper connector connects to the at least one shoulder strap using at least one quick-releasable connector system.

9. The system of claim 8 wherein the at least one quick-releasable connector system is selected from the group consisting of hook-and-loop straps, ball-and-socket connectors, side-squeeze buckle connectors, and buckle-and-tongue connectors.

10. The system of claim 1 wherein the lower region comprises a first lower section, a second lower section, and at least one horizontal section extending between the first lower section and the second lower section.

11. The system of claim 10 wherein the lower region further comprises a first lower connector, a second lower connector, and an inter-sliding adjustment mechanism, in which a first frame element slides substantially parallel to a longitudinal dimension of a second frame element, to adjust the distance between the first lower connector and the second lower connector.

12. The system of claim 1 wherein the at least one accommodation mechanism comprises at least one frame section that is resiliently flexible along a longitudinal axis.

13. The system of claim 1 wherein the at least one article securing mechanism is selected from the group consisting of straps, buckles, and holders.

14. The system of claim 1, wherein the accommodation mechanism enables the upper region to move in relation to the lower region so that a length of the frame along one or more of the upper and lower regions can change automatically in response to changes in the position of the user's torso during use of the system.

15. A system for carrying articles at the front torso of a human user, the system comprising:

at least one shoulder strap and at least one hip belt adapted to be worn by the user, with the at least one shoulder strap operably tightened about the user and having at least one segment positioned upon a front pectoral region of the user;

a frame having an upper region and a lower region;

the lower region having at least one lower section that is sufficiently rigid to support the weight of at least one article secured upon the lower region and to transfer the weight of the at least one article downward;

the lower region having at least one lower connector to connect the lower region to the at least one hip belt;

the upper region having at least one upper section that is sufficiently rigid to position and restrict the movement of the upper region in relation to the at least one shoulder strap;

the upper region having at least one upper connector to connect the upper region to the at least one shoulder strap;

the at least one lower connector and the at least one upper connector located on a same side of a center sagittal plane of the user;

the frame having at least one accommodation mechanism that enables the upper region to move in relation to the lower region so that the distance between the at least one lower connector and the at least one upper connector can change automatically in response to changes in the position of the user's torso during use of the system; and at least one article securing mechanism directly attached to the frame.

16. The system of claim 15 wherein the at least one accommodation mechanism comprises at least one inter-sliding assembly in which a first frame element slides substantially parallel to a longitudinal dimension of a second frame element.

17. The system of claim 16 wherein the at least one inter-sliding assembly is selected from the group consisting of telescopic assemblies and sliding dovetail assemblies.

18. The system of claim 15 wherein the at least one accommodation mechanism comprises at least one foldable assembly.

19. The system of claim 18 wherein the at least one foldable assembly is selected from the group consisting of hinges and ball joints.

20. The system of claim 15 wherein the at least one lower connector connects to the at least one hip belt using at least one quick-releasable connector system.

21. The system of claim 20 wherein the at least one quick-releasable connector system is selected from the group consisting of hook-and-loop straps, ball-and-socket connectors, side-squeeze buckle connectors, and buckle-and-tongue connectors.

22. The system of claim 15 wherein the at least one upper connector connects to the at least one shoulder strap using at least one quick-releasable connector system.

23. The system of claim 22 wherein the at least one quick-releasable connector system is selected from the group consisting of hook-and-loop straps, ball-and-socket connectors, side-squeeze buckle connectors, and buckle-and-tongue connectors.

24. The system of claim 15 wherein the lower region comprises a first lower section, a second lower section, and at least one horizontal section extending between the first lower section and the second lower section.

25. The system of claim 24 wherein the lower region further comprises a first lower connector, a second lower connector, and an inter-sliding adjustment mechanism, in which a first frame element slides substantially parallel to a longitudinal dimension of a second frame element, to adjust the distance between the first lower connector and second lower connector.

26. The system of claim 15 wherein the at least one article securing mechanism is selected from the group consisting of straps, buckles, and holders.

27. The system of claim 15, wherein the accommodation mechanism enables the upper region to move in relation to the lower region so that a length of the frame along one or more of the upper and lower regions can change automatically in response to changes in the position of the user's torso during use of the system.

28. The system of claim 15 wherein the at least one accommodation mechanism comprises at least one frame section that is resiliently flexible along a longitudinal axis.

29. A system for carrying articles at the front torso of a human user who is wearing a harness having at least one shoulder strap and at least one hip belt, with the at least one shoulder strap operably tightened about the user and having at least one segment positioned upon a front pectoral region of the user, the system comprising:

at least one shoulder strap connector having a releasable attachment mechanism to attach the at least one shoulder strap connector to the at least one shoulder strap and to remove the at least one shoulder strap connector from the at least one shoulder strap;

at least one hip belt connector having a releasable attachment mechanism to attach the at least one hip belt connector to the at least one hip belt and to remove the at least one hip belt connector from the at least one hip belt;

a frame having an upper region and a lower region;

the lower region having at least one lower section that is sufficiently rigid to support the weight of at least one article secured upon the lower region and to transfer the weight of the at least one article downward;

the lower region having at least one lower connector to connect the lower region to the at least one hip belt connector;

the upper region having at least one upper section that is sufficiently rigid to position and restrict the movement of the upper region in relation to the at least one shoulder strap;

the upper region having at least one upper connector to connect the upper region to the at least one shoulder strap connector;

the at least one lower connector and the at least one upper connector located on a same side of a center sagittal plane of the user;

the frame having at least one accommodation mechanism that enables the upper region to move in relation to the lower region so that the distance between the at least one lower connector and the at least one upper connector can change automatically in response to changes in the position of the user's torso during use of the system; and at least one article securing mechanism directly attached to the frame.

30. The system of claim 29 wherein the at least one accommodation mechanism comprises at least one inter-sliding assembly in which a first frame element slides substantially parallel to a longitudinal dimension of a second frame element.

31. The system of claim 30 wherein the at least one inter-sliding assembly is selected from the group consisting of telescopic assemblies and sliding dovetail assemblies.

32. The system of claim 29 wherein the at least one accommodation mechanism comprises at least one foldable assembly.

33. The system of claim 32 wherein the at least one foldable assembly is selected from the group consisting of hinges and ball joints.

34. The system of claim 29 wherein the at least one lower connector connects to the at least one hip belt connector using at least one quick-releasable connector system.

35. The system of claim 34 wherein the at least one quick-releasable connector system is selected from the group consisting of ball-and-socket connectors, side-squeeze buckle connectors, and buckle-and-tongue connectors.

36. The system of claim 29 wherein the at least one upper connector connects to the at least one shoulder strap connector using at least one quick-releasable connector system.

37. The system of claim 36 wherein the at least one quick-releasable connector system is selected from the group consisting of ball-and-socket connectors, side-squeeze buckle connectors, and buckle-and-tongue connectors.

38. The system of claim 29 wherein the lower region comprises a first lower section, a second lower section, and at least one horizontal section extending between the first lower section and the second lower section.

39. The system of claim 38 wherein the lower region further comprises a first lower connector, a second lower connector, and an inter-sliding adjustment mechanism, in which a first frame element slides substantially parallel to a longitudinal dimension of a second frame element, to adjust the distance between the first lower connector and second lower connector.

40. The system of claim 29 wherein the at least one accommodation mechanism comprises at least one frame section that is resiliently flexible along a longitudinal axis.

41. The system of claim 29 wherein the at least one article securing mechanism is selected from the group consisting of straps, buckles, and holders.

42. The system of claim 29, wherein the accommodation mechanism enables the upper region to move in relation to the lower region so that a length of the frame along one or more of the upper and lower regions can change automatically in response to changes in the position of the user's torso during use of the system.

43. A system for carrying articles at the front torso of a human user who is wearing at least one shoulder strap and at least one hip belt, the system comprising:

at least one shoulder strap connector to attach to the at least one shoulder strap;

at least one hip belt connector to attach to the at least one hip belt;

a frame having an upper region and a lower region;

the lower region having at least one lower section that is sufficiently rigid to support the weight of at least one article secured upon the lower region and to transfer the weight of the at least one article downward;

the lower region having at least one lower connector to connect the lower region to the at least one hip belt connector;

the upper region having at least one upper section that is sufficiently rigid to position and restrict the movement of the upper region in relation to the at least one shoulder strap;

the upper region having at least one upper connector to connect the upper region to the at least one shoulder strap connector;

the frame having at least one accommodation mechanism that enables the upper region to move in relation to the lower region so that the distance between the at least one lower connector and the at least one upper connector can change automatically in response to changes in the position of the user's torso during use of the system; and at least one article securing mechanism attached to the frame.

44. A system for carrying articles at the front torso of a human user who is wearing at least one shoulder strap and at least one hip belt, the system comprising:

a frame having an upper region and a lower region;

the lower region having at least one lower section that is sufficiently rigid to support the weight of at least one article secured upon the lower region and to transfer the weight of the at least one article downward;

the lower region having at least one lower connector to connect the lower region to the at least one hip belt;

the upper region having at least one upper section that is sufficiently rigid to position and restrict the movement of the upper region in relation to the at least one shoulder strap;

at least one shoulder strap connector to attach to the at least one shoulder strap;

the at least one shoulder strap connector having a shaped area that captures the upper region to restrict the horizontal movement of the upper region in relation to the at least one shoulder strap connector, while leaving the upper region substantially free to move in the vertical dimension in relation to the at least one shoulder strap connector, so that the distance between the at least one shoulder strap connector and the at least one lower connector can change automatically in response to changes in the position of the user's torso during use of the system; and at least one article securing mechanism attached to the frame.

45. A system for carrying articles at the front torso of a human user who is wearing a harness having at least one shoulder strap and at least one hip belt, with the at least one shoulder strap operably tightened about the user and having at least one segment positioned upon a front pectoral region of the user, the system comprising:

a frame having an upper region and a lower region;

the lower region having at least one lower section that is sufficiently rigid to support the weight of at least one article secured upon the lower region and to transfer the weight of the at least one article downward;

the lower region having at least one lower connector to connect the lower region to the at least one hip belt;

the upper region having at least one upper section that is sufficiently rigid to position and restrict the movement of the upper region in relation to the at least one shoulder strap;

at least one shoulder strap connector to attach to the at least one shoulder strap;

the at least one lower connector and the at least one shoulder strap connector located on a same side of a center sagittal plane of the user;

the at least one shoulder strap connector having a shaped area that captures the upper region to restrict the horizontal movement of the upper region in relation to the at least one shoulder strap connector, while leaving the upper region substantially free to move in the vertical dimension in relation to the at least one shoulder strap connector, so that the distance between the at least one shoulder strap connector and the at least one lower connector can change automatically in response to changes in the position of the user's torso during use of the system.

46. The system of claim 45 wherein the at least one lower connector connects to the at least one hip belt using at least one quick-releasable connector system.

47. The system of claim 46 wherein the at least one quick-releasable connector system is selected from the group consisting of hook-and-loop straps, ball-and-socket connectors, side-squeeze buckle connectors, and buckle-and-tongue connectors.

48. The system of claim 45 wherein the at least one shoulder strap connector attaches to the at least one shoulder strap using at least one quick-releasable attachment system.

49. The system of claim 48 wherein the at least one quick-releasable attachment system comprises at least one strap.

50. The system of claim 45 further comprising at least one article securing mechanism attached to the frame.

51. The system of claim 50 wherein the at least one article securing mechanism is selected from the group consisting of straps, buckles, and holders.

52. The system of claim 45 wherein the lower region comprises a first lower section, a second lower section, and at least one horizontal section extending between the first lower section and the second lower section.

53. The system of claim 52 wherein the lower region further comprises a first lower connector, a second lower connector, and an inter-sliding adjustment mechanism, in which a first frame element slides substantially parallel to a longitudinal dimension of a second frame element, to adjust the distance between the first lower connector and the second lower connector.

* * * * *